US005718345A

United States Patent [19]

Hade, Jr.

[11] Patent Number: 5,718,345

[45] Date of Patent: Feb. 17, 1998

[54] CARRIER TRACK SYSTEM FOR INDEPENDENT AND/OR SYNCHRONIZED OPERATION OF A MULTI-SECTION TELESCOPIC BOOM STRUCTURE

[75] Inventor: Donald C. Hade, Jr., Waynesboro, Pa.

[73] Assignee: Kidde Industries, Inc., Iselin, N.J.

[21] Appl. No.: 692,458

[22] Filed: Aug. 5, 1996

Related U.S. Application Data

[63] Continuation of Ser. No. 312,836, Sep. 27, 1994, abandoned.

[51] Int. Cl.[6] ..... B06C 23/06

[52] U.S. Cl. ..... 212/349; 152/118

[58] Field of Search ..... 212/231, 348, 212/349, 350; 182/2; 52/118

[56] References Cited

U.S. PATENT DOCUMENTS

| | | | |
|---|---|---|---|
| 3,467,217 | 9/1969 | Zwight | 182/2 |
| 3,624,979 | 12/1971 | Przybylski | 212/231 |
| 3,776,367 | 12/1973 | Grove | 182/2 |
| 4,118,907 | 10/1978 | Small et al. | 52/115 |
| 4,133,411 | 1/1979 | Curb | 182/2 |
| 4,185,426 | 1/1980 | Prescott | 52/115 |
| 4,360,077 | 11/1982 | Abbott | 182/2 |
| 4,470,229 | 9/1984 | Muse et al. | 52/118 |
| 4,506,480 | 3/1985 | Murrill et al. | 52/121 |
| 4,588,347 | 5/1986 | Murta | 414/685 |
| 4,789,120 | 12/1988 | Spidel | 248/49 |
| 4,809,472 | 3/1989 | Hade, Jr. et al. | 52/118 |
| 4,954,041 | 9/1990 | Dahlquist et al. | 414/718 |
| 5,249,643 | 10/1993 | Backer et al. | 182/2 |

*Primary Examiner*—Thomas J. Brahan

[57] ABSTRACT

A carrier track system for a multi-section telescopic boom structure having a base section, a mid section and a fly section. A pair of flexible tracks carrying flexible hydraulic hoses and electrical cables are positioned within the base and fly sections and are respectively connected between the inner end of the mid section and the bottom wall of the base section; and the inner end of the mid section and the bottom wall of the fly section. A pair of spaced, longitudinally extending channels are positioned within the base and fly sections for guiding the flexible tracks, reinforcing the side walls of the base and fly sections, providing housing for fixed hydraulic and electrical conduits, and providing a support for the wear pads on the inner end of the mid section. A dual rod hydraulic cylinder is connected between the telescopic boom section so that each section can be selectively operated independently, or in a synchronized or proportional manner relative to each other.

9 Claims, 28 Drawing Sheets

CARRIER TRACK SYSTEM FOR INDEPENDENT AND/OR SYNCHRONIZED OPERATION OF A MULTI-SECTION TELESCOPIC BOOM STRUCTURE

This application is a continuation of application Ser. No. 08/312,836 filed on Sep. 27, 1994, now abandoned.

BACKGROUND OF THE INVENTION

Various track systems and guide members have been proposed for extensible and retractable telescopic boom structures, such as cranes, aerial work platforms and the like, for supporting flexible hoses and cables required for transmitting power to the work unit mounted on the outer-most end of the telescopic boom. Examples of such track systems are disclosed in U.S. Pat. Nos. 4,506,480, dated Mar. 25, 1985; 4,789,120, dated Dec. 6, 1988; and 4,809,472, dated Mar. 7, 1989.

While the track systems and guide members disclosed in the above-mentioned patents have been satisfactory for their intended purpose, by their construction and arrangement they have been limited for use in multi-section telescopic boom structures, wherein the boom sections can only be operated independently, or in a synchronized manner, so that the track will not be damaged during the operation of the boom sections.

SUMMARY OF THE INVENTION

After considerable research and experimentation, the carrier track system of the present invention has been devised for a multi-section telescopic boom structure, such as, a three-section telescopic boom riser assembly or a three-section telescopic boom having a base section, a mid section and a fly section, wherein the carrier track system comprises, essentially, a pair of cable carrier tracks. One end of a first carrier track is connected to the inner end of the mid section, and the other end of the first carrier track is connected to the bottom wall of the base section intermediate the ends thereof. The first carrier track is bent back upon itself so that the rolling bight portion faces in a forward direction toward the fly section. One end of a second carrier track is connected to the outer end of a longitudinally extending cable support tube secured to the inner end of the mid section and extending in a direction toward the outer end of the mid section. The other end of the second carrier track is secured to the bottom wall of the fly section at the inner end thereof. The second carrier track is bent back on itself so that the rolling bight portion faces in a rearward direction toward the base section. A dual rod hydraulic cylinder is connected between the telescopic boom sections, whereby each boom section can be selectively operated independently, or all the boom sections in a synchronized manner relative to each other.

The carrier tracks are positioned interiorly of their respective boom sections and are guided therein by spaced longitudinally extending channels positioned at the bottom corners of the base section and fly section, the channels being formed by right angle members having one edge welded to the inner surface of the side wall of the boom section, and the other edge welded to the inner surface of the bottom wall of the boom section. By this construction, the channels perform a fourfold function; namely, they reinforce the side walls of the base section and fly section against buckling due to excessive stress; they provide housings for hydraulic hoses and electrical cables employed in the assembly; the space between the channels provides a trough for guiding the carrier tracks within the boom section; and the top surfaces of the channels in the base section support the bottom rear wear pads on the mid section.

DESCRIPTION OF THE PREFERRED EMBODIMENT

Figure 1:
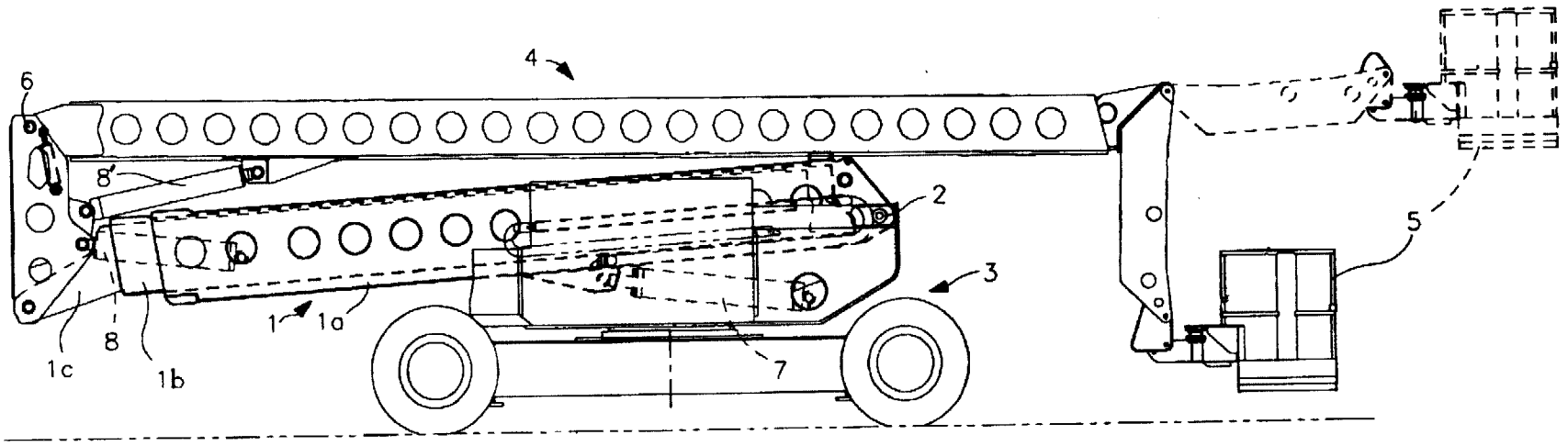
FIG. 1 is a side elevational view of an articulated boom mobile aerial work platform, in a retracted position, having a three-section telescopic boom riser assembly showing the carrier track system in accordance with the present invention in phantom lines.
Figure 2:
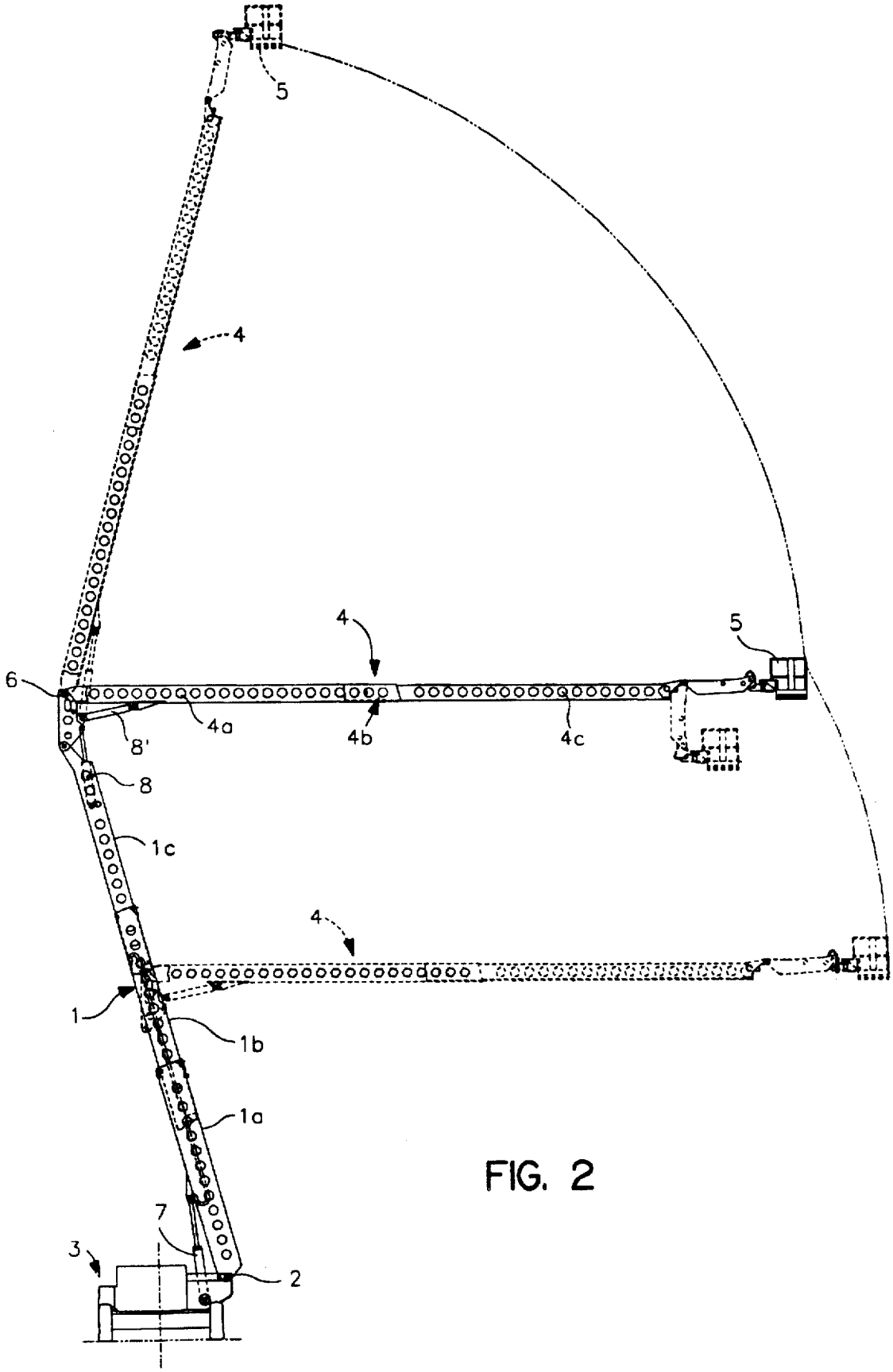
FIG. 2 is a side elevational view showing the mobile aerial work platform in various raised working positions, and showing the three-section telescopic boom riser assembly in an extended position.

Referring to the drawings in greater detail, and more particularly to FIGS. 1 and 2, the carrier track system of the present invention is adapted to be employed in a mobile aerial work platform of the type disclosed in U.S. Pat. No. 5,249,643, dated Oct. 5, 1993, wherein a three-section telescopic boom riser assembly 1 having a base section 1a, a mid section 1b, and a fly section 1c is pivotally connected at the base end as at 2 to a vehicle chassis 3. A telescopic boom assembly 4 having a work platform 5 mounted on one end thereof is pivotally connected to the riser assembly 1 as at 6. Suitable hydraulic lift cylinders 7, 8 and 8' are connected respectively to the riser assembly 1 and boom assembly 4 for the luffing thereof.

Figure 3:
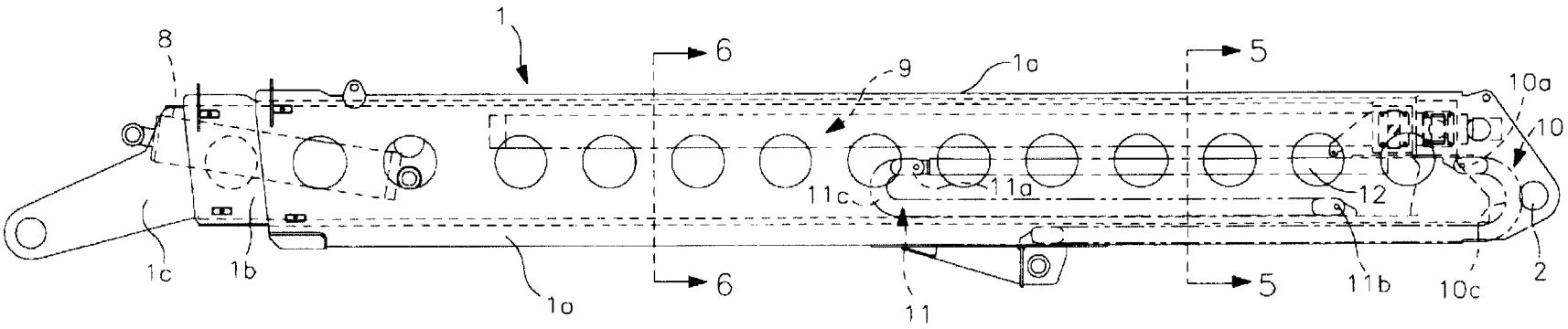
FIG. 3 is an enlarged side elevational view of the three-section telescopic boom riser assembly in a retracted position.
Figure 4:
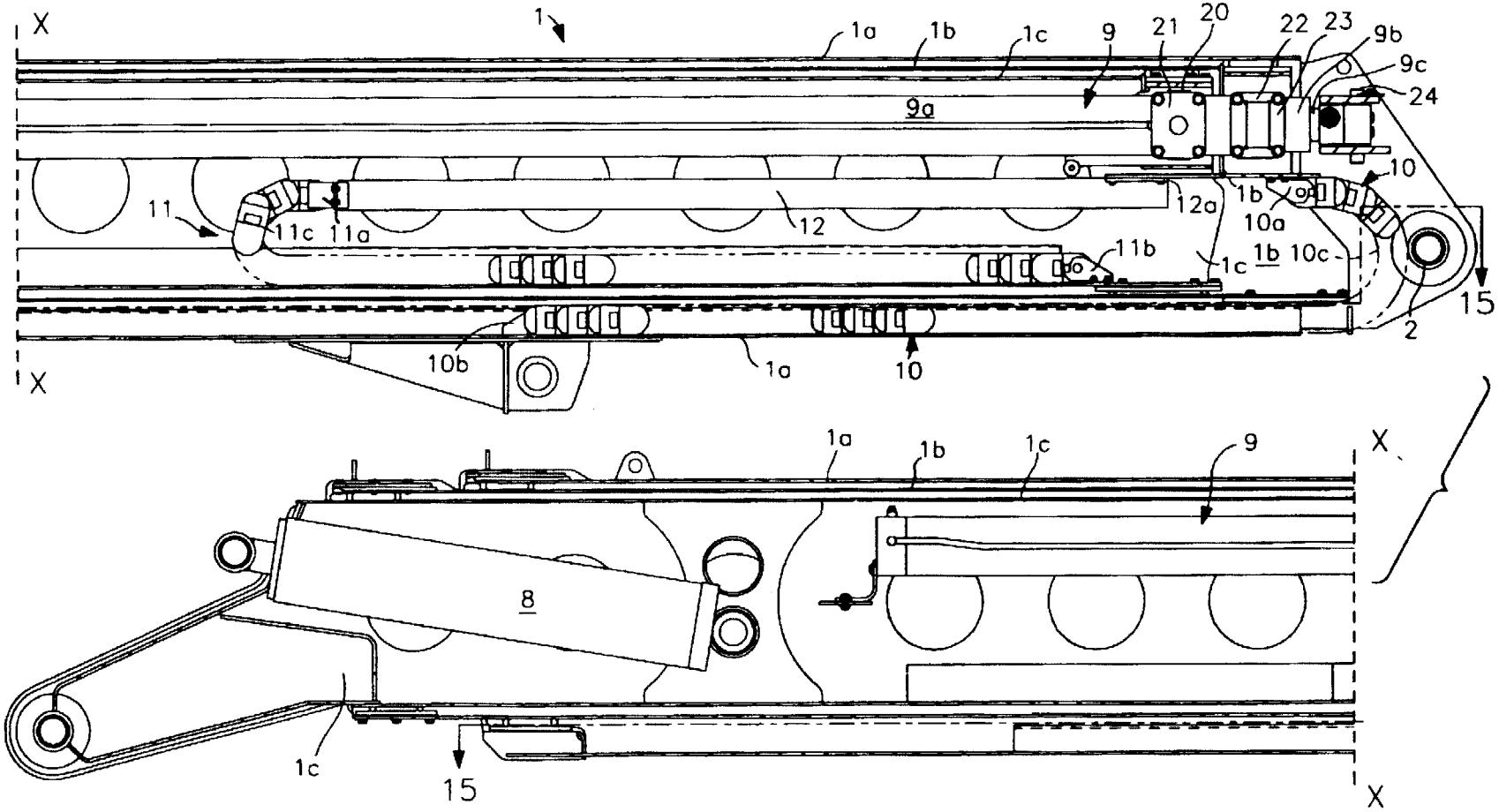
FIG. 4 is a longitudinal sectional view, on an enlarged scale, of the retracted three-section telescopic boom riser assembly of FIG. 3, the drawing Figure consisting of two portions which are joined longitudinally on the match line X—X, and showing the carrier track system in the retracted position of the telescopic structure, and showing the longitudinally extending conduit and carrier track guide members in elevation.

As will be seen in FIGS. 3 and 4, a dual rod hydraulic cylinder 9 is operatively connected between the boom sections 1a, 1b and 1c, whereby the boom sections can be extended or retracted independently or in a synchronized manner relative to each other. In order to accommodate the various hydraulic hoses and electrical cables employed in the system, particularly to prevent damage to the hoses and cables during the telescopic movement of the boom sections, and eliminate the need for spring loaded base take-up reels, a pair of conventional flexible carrier tracks 10 and 11 are employed for supporting the hoses and cables interior thereof, as known. The first carrier track 10 has one end connected to the inner end of the mid section 1b as at 10a and the other end connected to the bottom wall of the base section 1a, intermediate the ends thereof, as at 10b. The carrier track 10 is bent back upon itself so that the rolling bight portion 10c faces in a forward direction toward the fly section 1c.

The second carrier track 11 has one end connected as at 11a to the outer end of a longitudinally extending hose and cable support tube 12 secured to the inner end of the mid section 1b as at 12a. The other end of the carrier track 11 is connected to the bottom wall of the fly section 1c as at 11b. The carrier track 11 is bent back upon itself so that the rolling bight portion 11c faces in a rearward direction toward the base section 1a.

Figure 6:
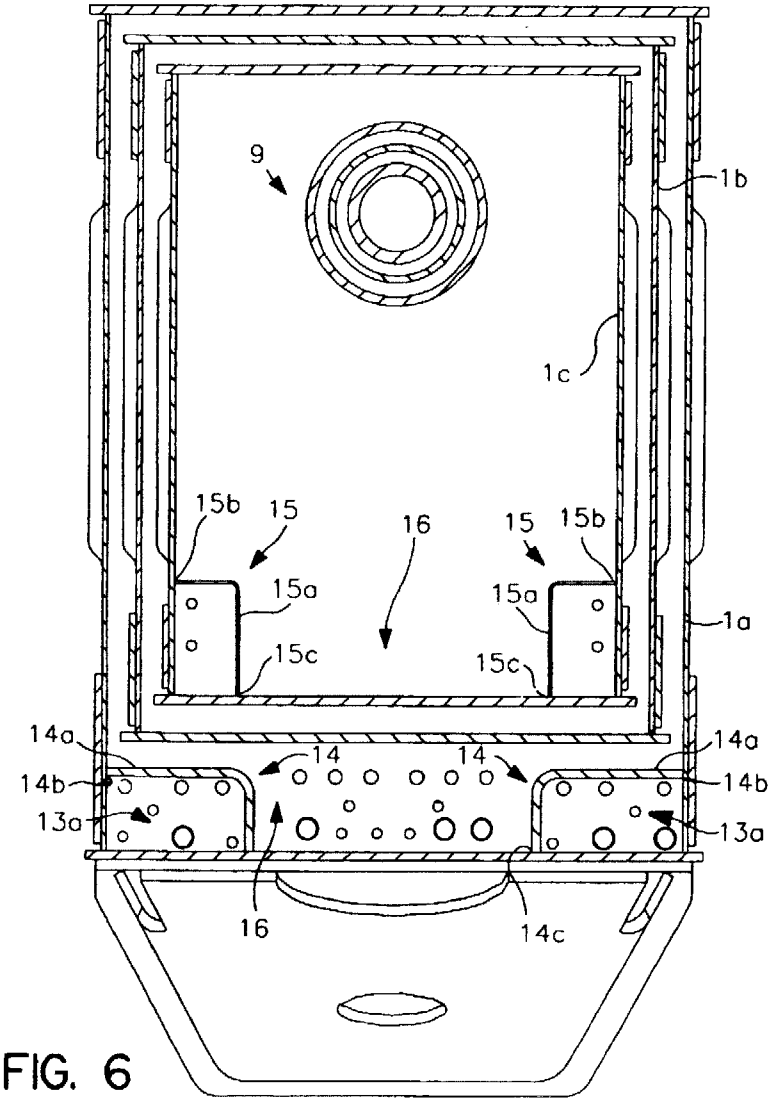
FIG. 6 is an enlarged cross-sectional view taken substantially along line 6—6 of FIG. 3.
Figure 5:
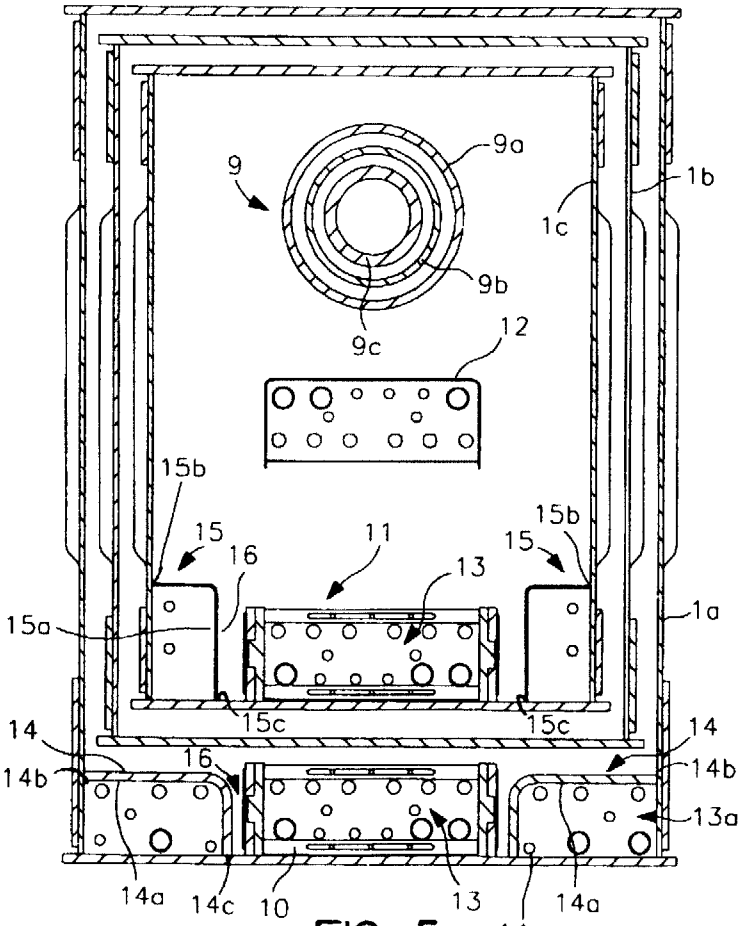
FIG. 5 is an enlarged cross-sectional view taken substantially along line 5—5 of FIG. 3, and particularly showing the carrier track members and the interior longitudinally extending guide members for the carrier track and hydraulic and electrical conduits.

As will be seen in FIGS. 5 and 6, the carrier tracks 10 and 11 carrying the various hydraulic hoses and electrical cables 13 are positioned interiorly of their respective boom sections 1a and 1c and are guided therein by spaced longitudinally extending channels 14 and 15 positioned at the bottom corners of the base section 1a and fly section 1c, respectively. The channels are formed by right angle members 14a and 15a having one edge welded to the inner surface of the side wall of the respective boom section as at 14b and 15b, and the other edge welded to the inner surface of the bottom wall of the respective boom section as at 14c and 15c.

Figure 10:
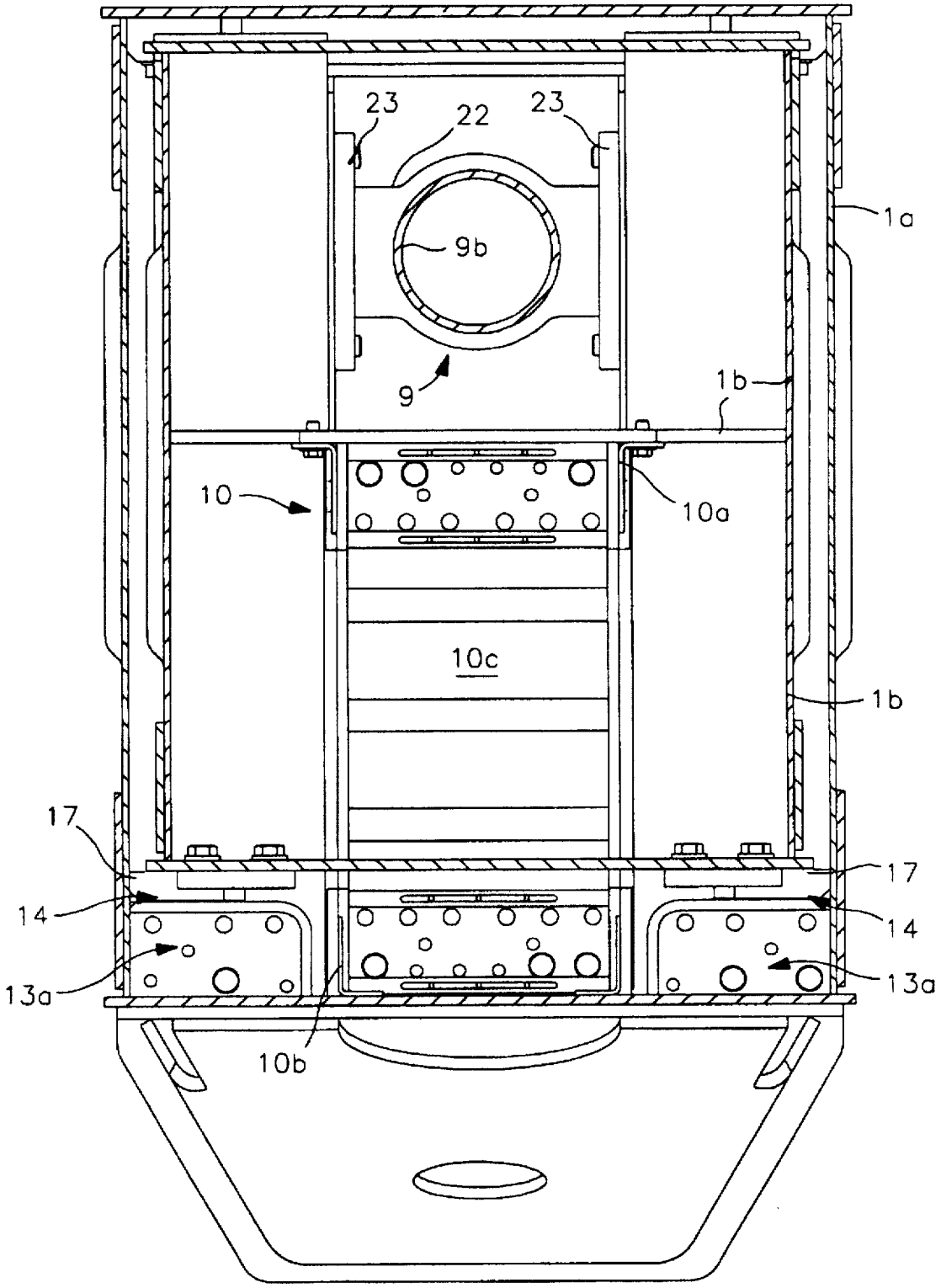
FIG. 10 is an enlarged cross-sectional view taken substantially along line 10—10 of FIG. 7, and particularly showing the bottom rear wear pad of the boom mid-section in sliding contact with the top surfaces of the longitudinally extending conduit and carrier track guide members.
Figure 15:
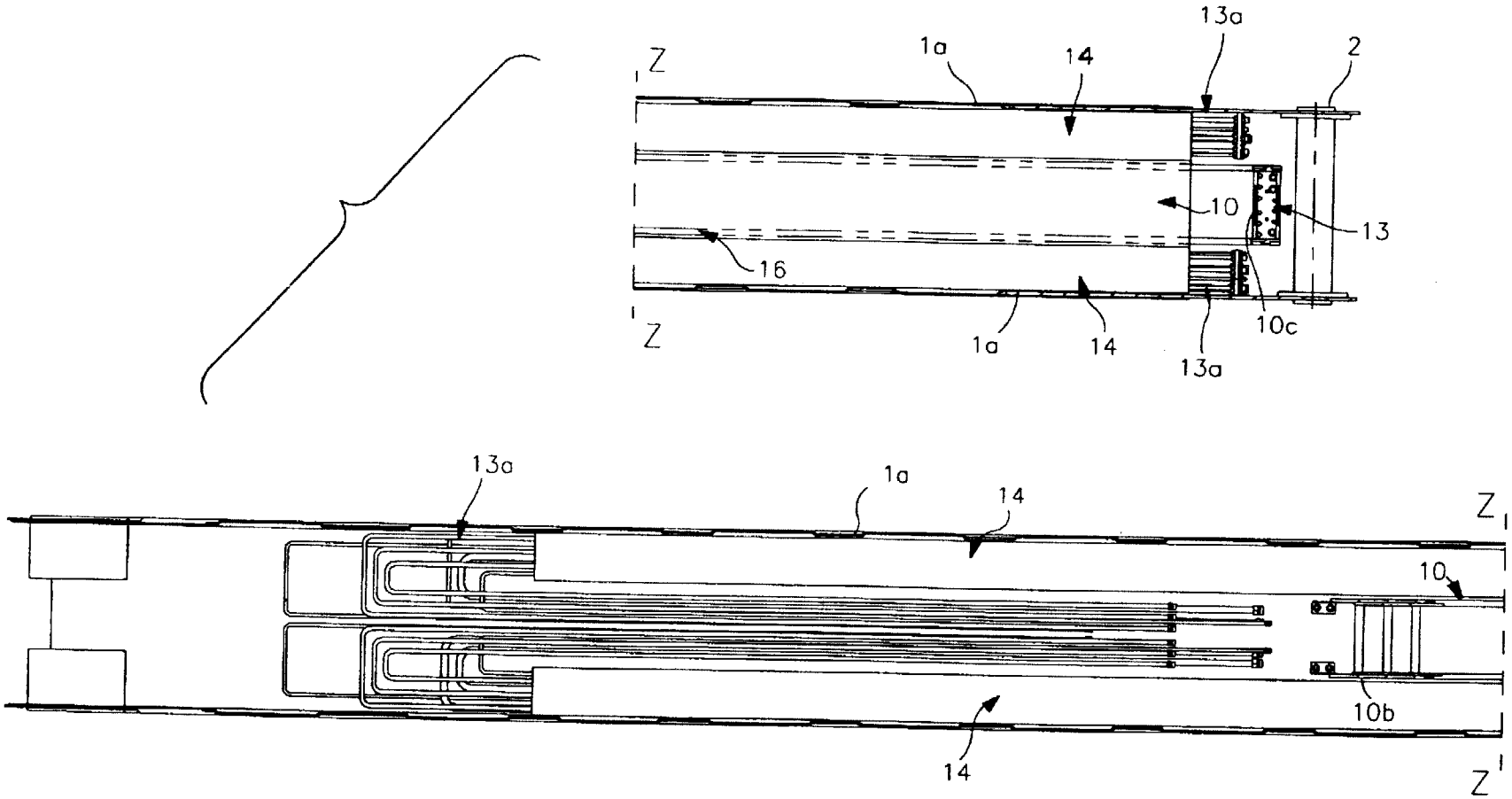
FIG. 15 is a longitudinal sectional view taken substantially along line 15—15 of FIG. 4, the drawing Figure consisting of two portions which are joined longitudinally on the match line Z—Z, and showing the spaced longitudinally extending conduit and carrier track guide members in the interior bottom portion of the base section of the telescopic structure, and showing conduits routed through the guide members into proximity for connection to flexible conduits which extend through the carrier track members, the flexible conduits not being shown for simplification and clarity of the view.

By the construction and arrangement of the channels 14 and 15, they perform a fourfold function; namely, they reinforce the side walls of the base section 1a and fly section 1c against buckling due to excessive stress, as shown in FIGS. 5 and 6, they provide housings for fixed conduits 13a adapted to be connected to the hydraulic hoses and electrical cables 13 carried by the carrier tracks 10 and 11, as shown in FIG. 15. The respective spaces between the channels provide guide troughs 16 for guiding the carrier tracks 10 and 11 within the boom section 1a and 1c, as shown in FIG. 5, and as shown in FIG. 10, the top surfaces of channels 14 support the bottom rear wear pads 17 on the mid section 1b, for sliding movement thereon as the mid section 1b slides in and out of the base section 1a.

Figure 7:
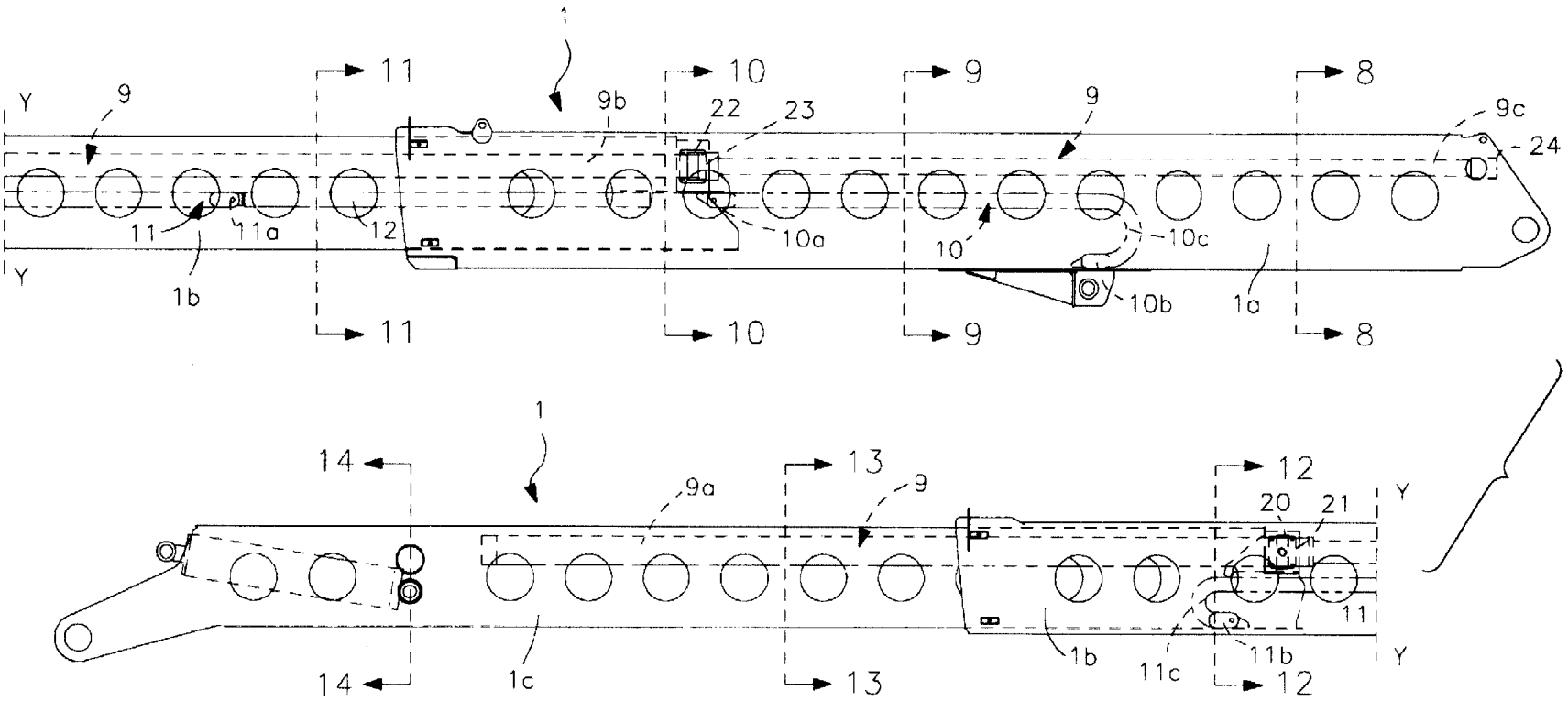
FIG. 7 is a side elevational view of the three-section telescopic boom riser in an extended position, and showing the carrier track system in the extended position in phantom, the drawing Figure consisting of two portions which are joined longitudinally on the match line Y—Y.
Figure 8:
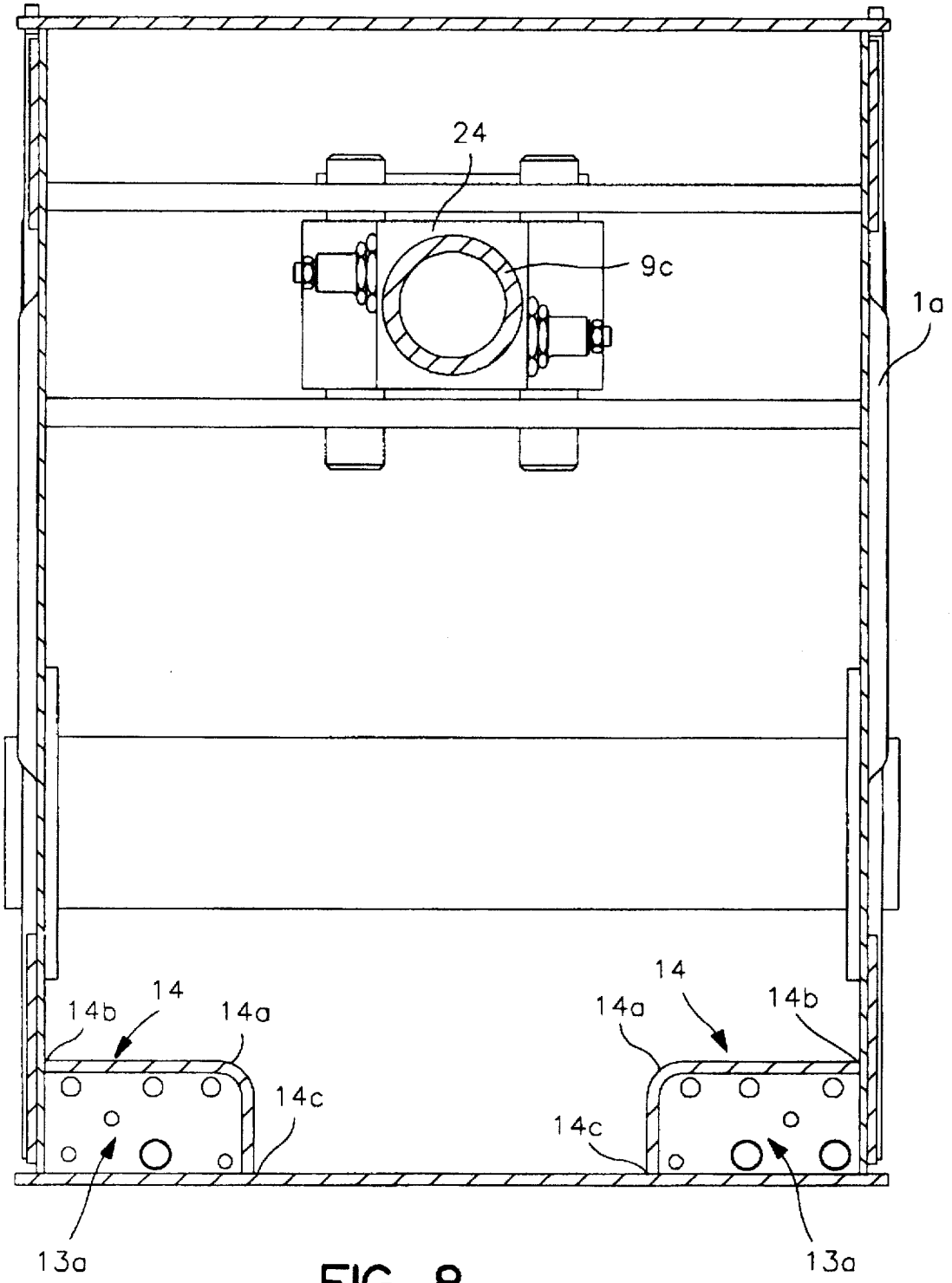
FIG. 8 is an enlarged cross-sectional view taken substantially on line 8—8 of FIG. 7.
Figure 9:
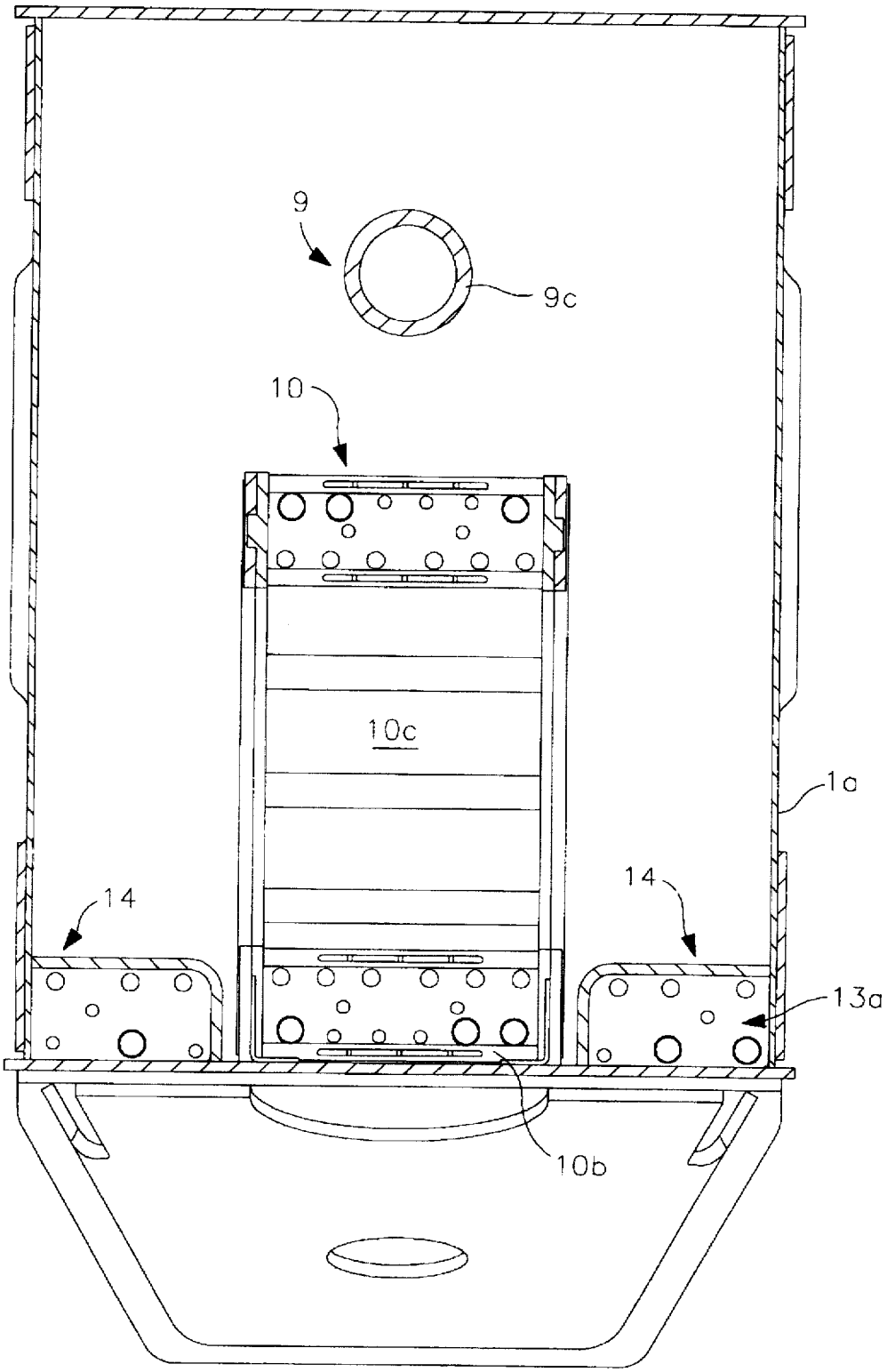
FIG. 9 is an enlarged cross-sectional view taken substantially along line 9—9 of FIG. 7.
Figure 18:
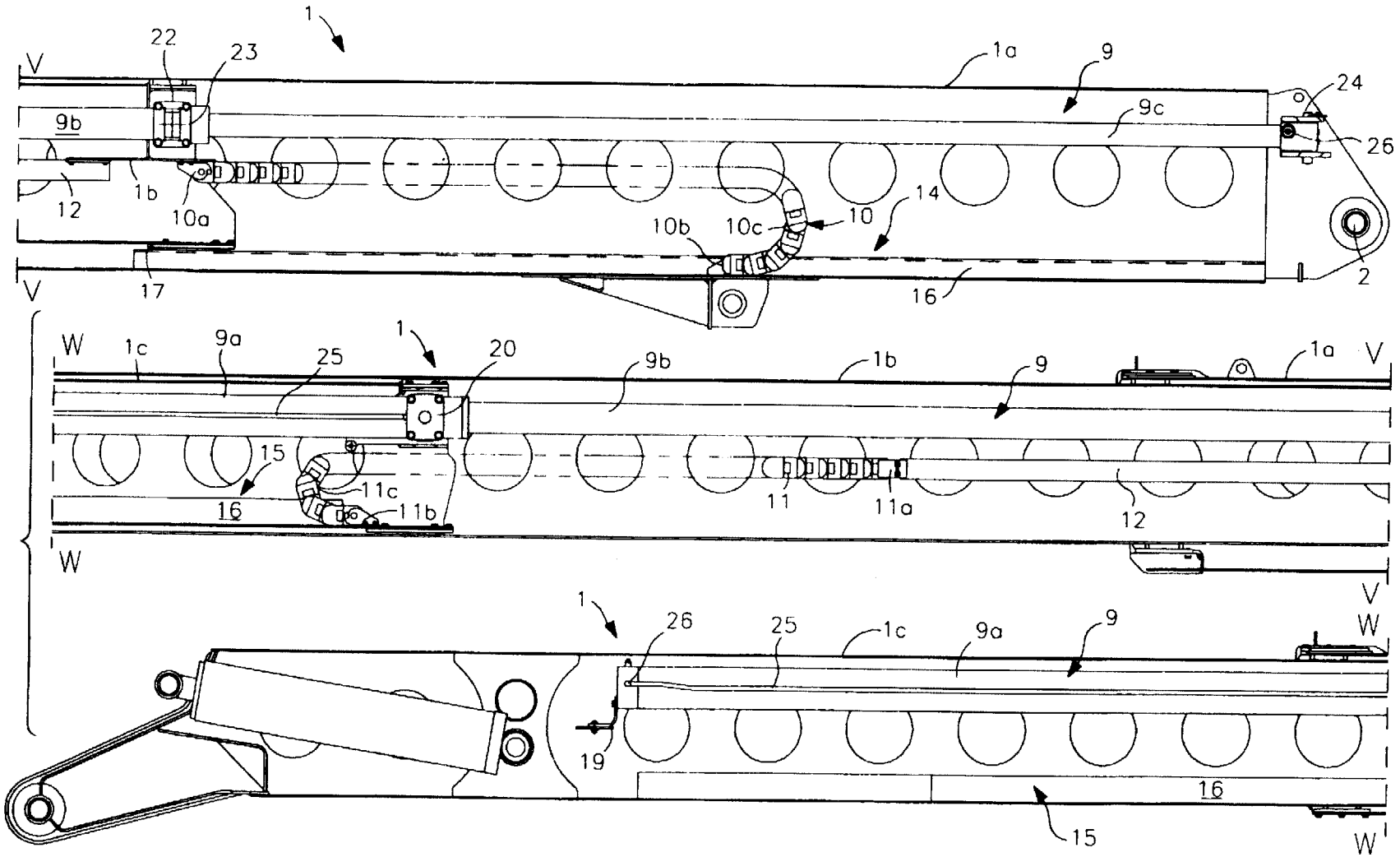
FIG. 18 is a longitudinal sectional view of the three-section telescopic boom riser structure in an extended position, the view being on an enlarged scale from that shown in FIG. 7, and the drawing Figure consisting of three portions which are joined longitudinally on the match lines B—B and W—W, respectively.

While FIGS. 3 and 4 illustrate the three-section telescopic boom riser assembly 1 in the retracted position, FIGS. 7 and 18 illustrate the riser assembly 1 and associated carrier tracks 10 and 11 in the extended position.

Figure 11:
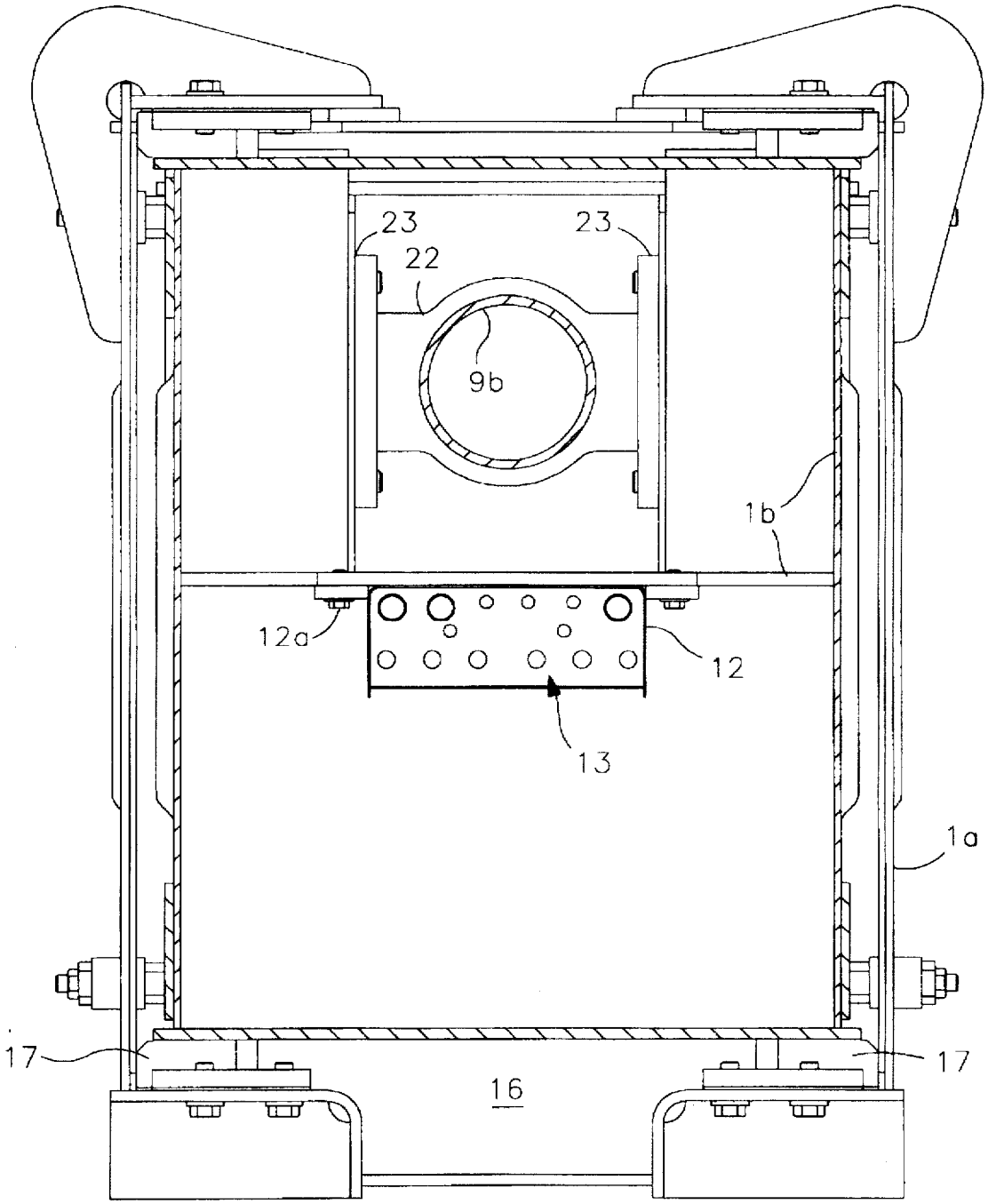
FIG. 11 is an enlarged cross-sectional view taken substantially along line 11—11 of FIG. 7.
Figure 12:
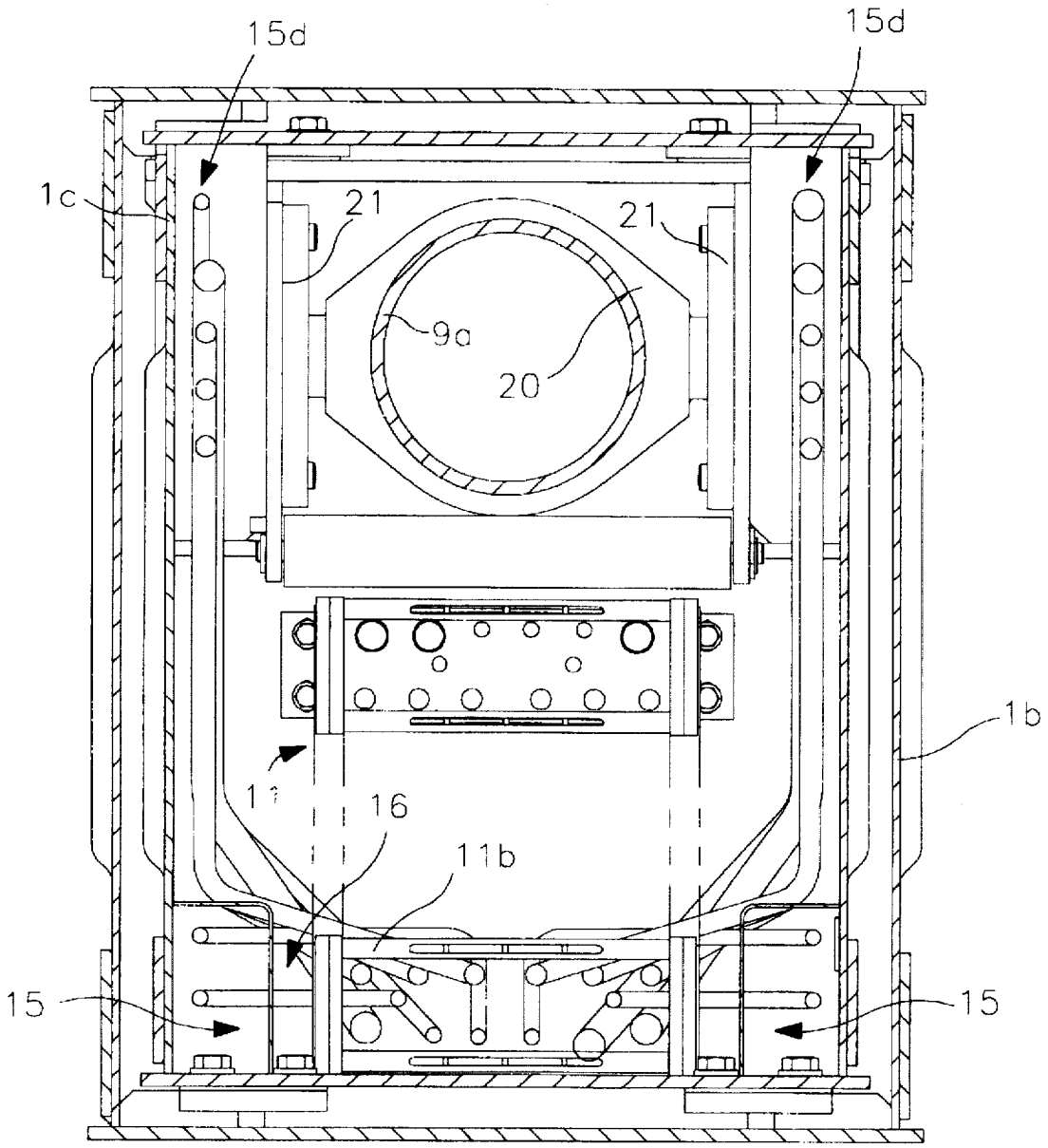
FIG. 12 is an enlarged cross-sectional view taken substantially along line 12—12 of FIG. 7.

Referring to FIG. 18, the dual rod hydraulic cylinder 9 for extending and retracting the boom sections 1a, 1b, 1c comprises a cylinder 9a having its closed end fixedly mounted within the fly section 1c by a bracket 19. The opposite end of the cylinder 9a extends through a collar 20 pivotally connected to a support 21, FIG. 12, mounted within the rear end of the fly section 1c. A first tubular rod 9b has one end slidably mounted within the cylinder 9a, and the opposite end extending through a collar 22 secured to a support 23, FIGS. 10 and 11, within the rear end of mid section 1b. A second tubular rod 9c has one end slidably mounted within the tubular rod 9b and the other end being closed and pivotally connected to the inner end of the base section as at 24. The hydraulic cylinder 9a and tubular rods 9b and 9c are provided with suitable conduits 25 and fittings 26 for the supply and exhaust of hydraulic fluid to the hydraulic cylinder, so that both rods 9b and 9c can be individually, selectively, independently extended, or they can be synchronously or proportionately extended, to provide the respective desired extension of the boom section.

Figure 13:
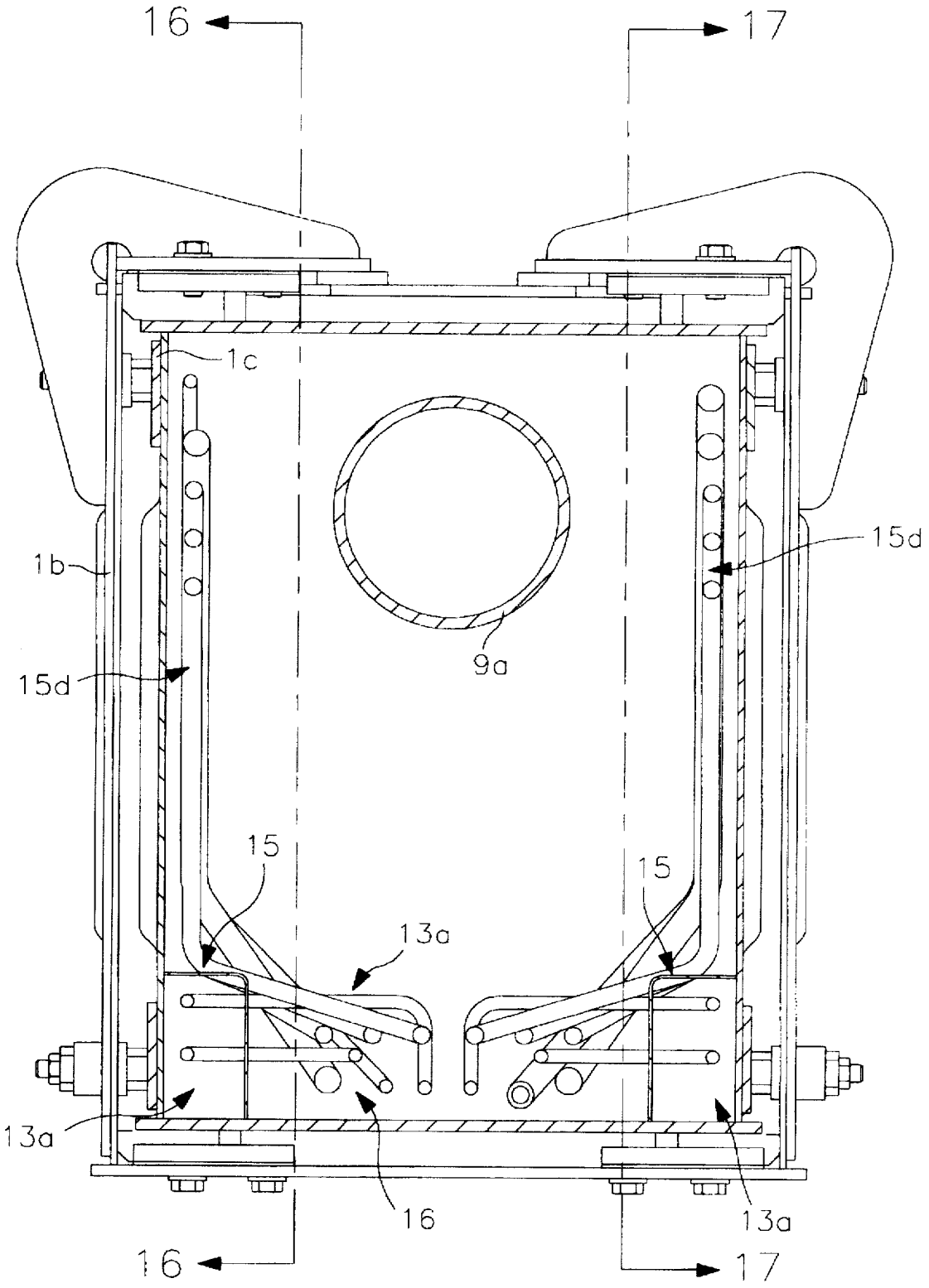
FIG. 13 is an enlarged cross-sectional view taken substantially along line 13—13 of FIG. 7.
Figure 14:
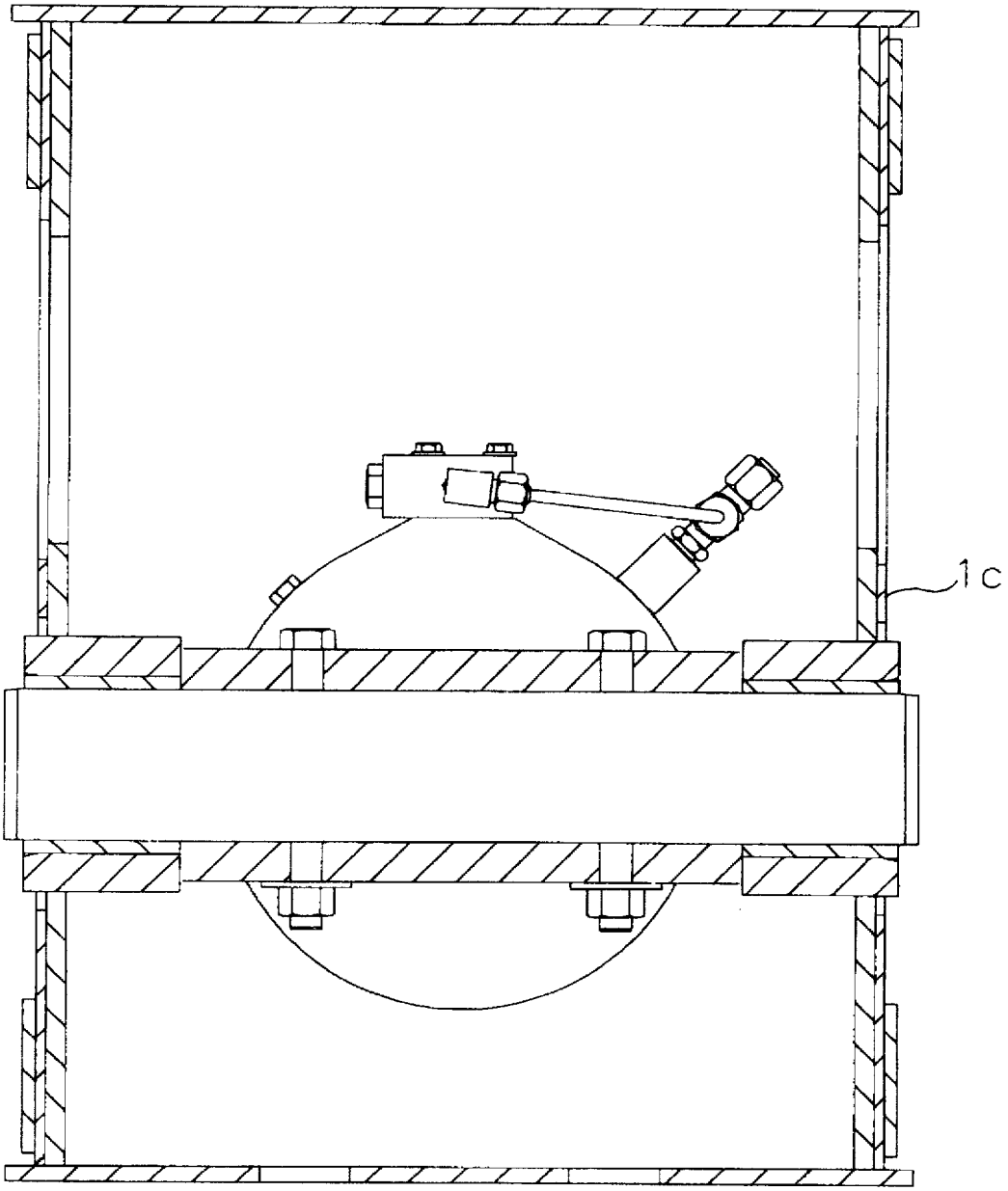
FIG. 14 is an enlarged cross-sectional view taken substantially along line 14—14 of FIG. 7.
Figure 16:
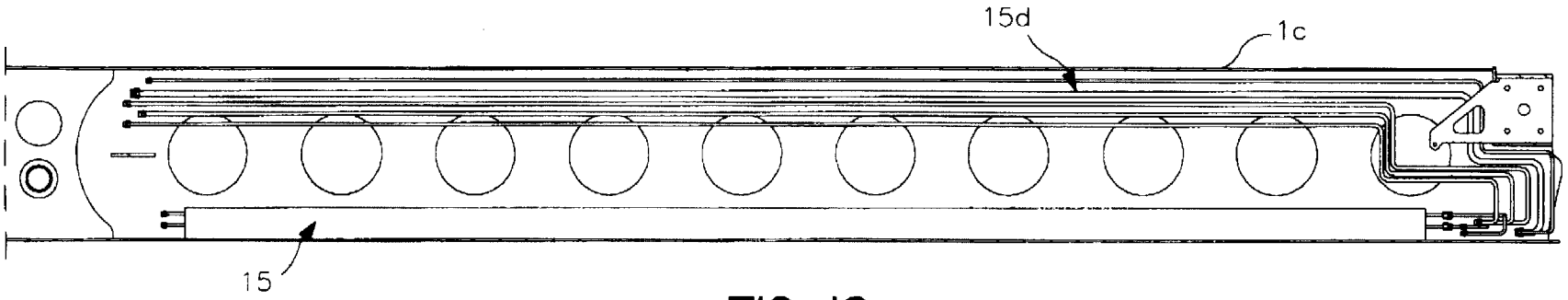
FIG. 16 is a longitudinal cross-sectional view taken substantially along line 16—16 of FIG. 13, on a reduced scale, and showing hydraulic and electrical conduits routed through conduit guide member in the fly section and mounted on the interior side wall of the fly section.
Figure 17:
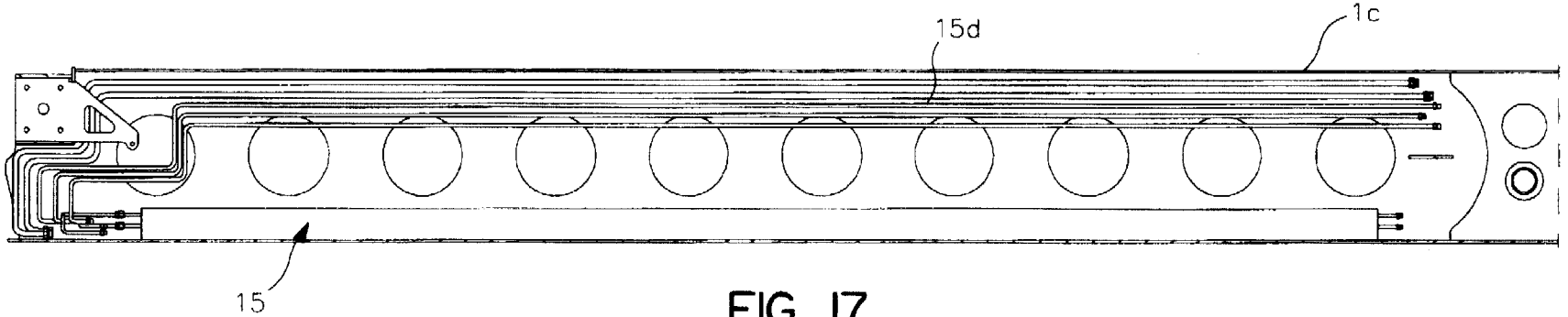
FIG. 17 is a longitudinal sectional view similar to FIG. 16, but taken substantially along line 17—17 of FIG. 13, and showing the opposite interior side wall of the fly section.

As will be seen in FIGS. 13, 16 and 17, besides the fixed conduits extending through the channels 15, additional fixed conduits 15d are provided in the fly section 1c which are positioned along the side walls of the boom section.

While the carrier track system of the present invention has been described for use in a three-section telescopic boom riser assembly 1, as shown in FIGS. 1 to 18, it can also be employed in a three-section telescopic boom assembly employed in a crane, or for supporting a work platform.

As will be seen in FIGS. 19 to 30, the three-section telescopic boom 27 comprises a base section 27a, a mid section 27b, and a fly section 27c. A dual rod hydraulic cylinder 28 is operatively connected between the boom sections 27a, 27b and 27c, whereby the boom sections can be extended or retracted independently or in a synchronized manner relative to each other. In order to prevent damage to the various flexible hoses and cables 29 (FIGS. 21, 22, 24 and 27) during the telescopic movement of the boom sections 27a, 27b, 27c, a pair of conventional flexible carrier tracks 30 and 31 are employed for supporting the flexible hoses and cables 29. The first carrier track 30 has one end connected to the inner end of the mid section 27b as at 30a and the other end connected to the bottom wall of the base section 27a as at 30b. The carrier track 30 is bent back upon itself so that the rolling bight portion 30c faces in a forward direction toward the fly section 27c.

Figure 22:
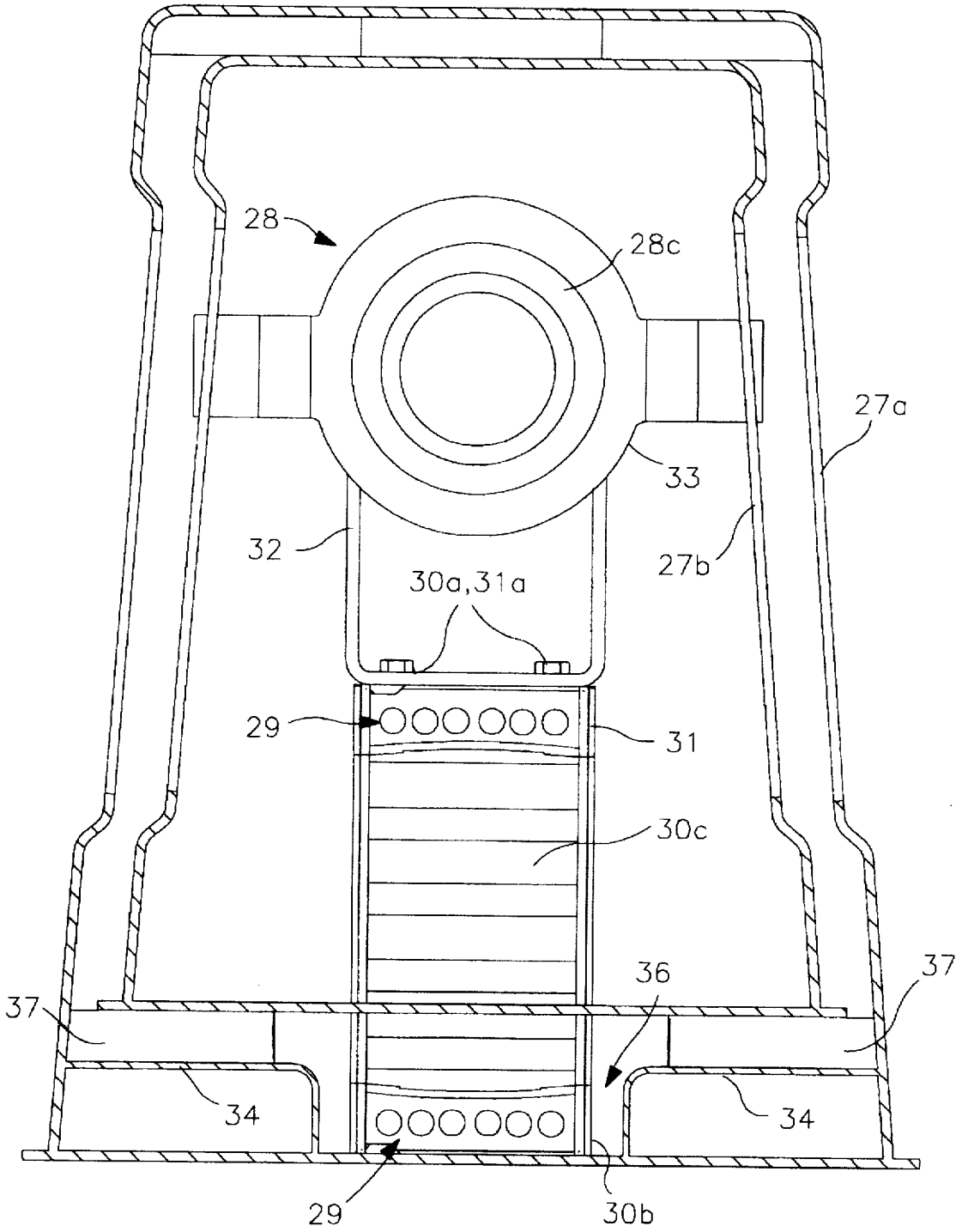
FIG. 22 is an enlarged cross-sectional view taken substantially along line 22—22 of FIG. 19, and particularly showing the connection of the carrier tracks to the boom mid-section.
Figure 23:
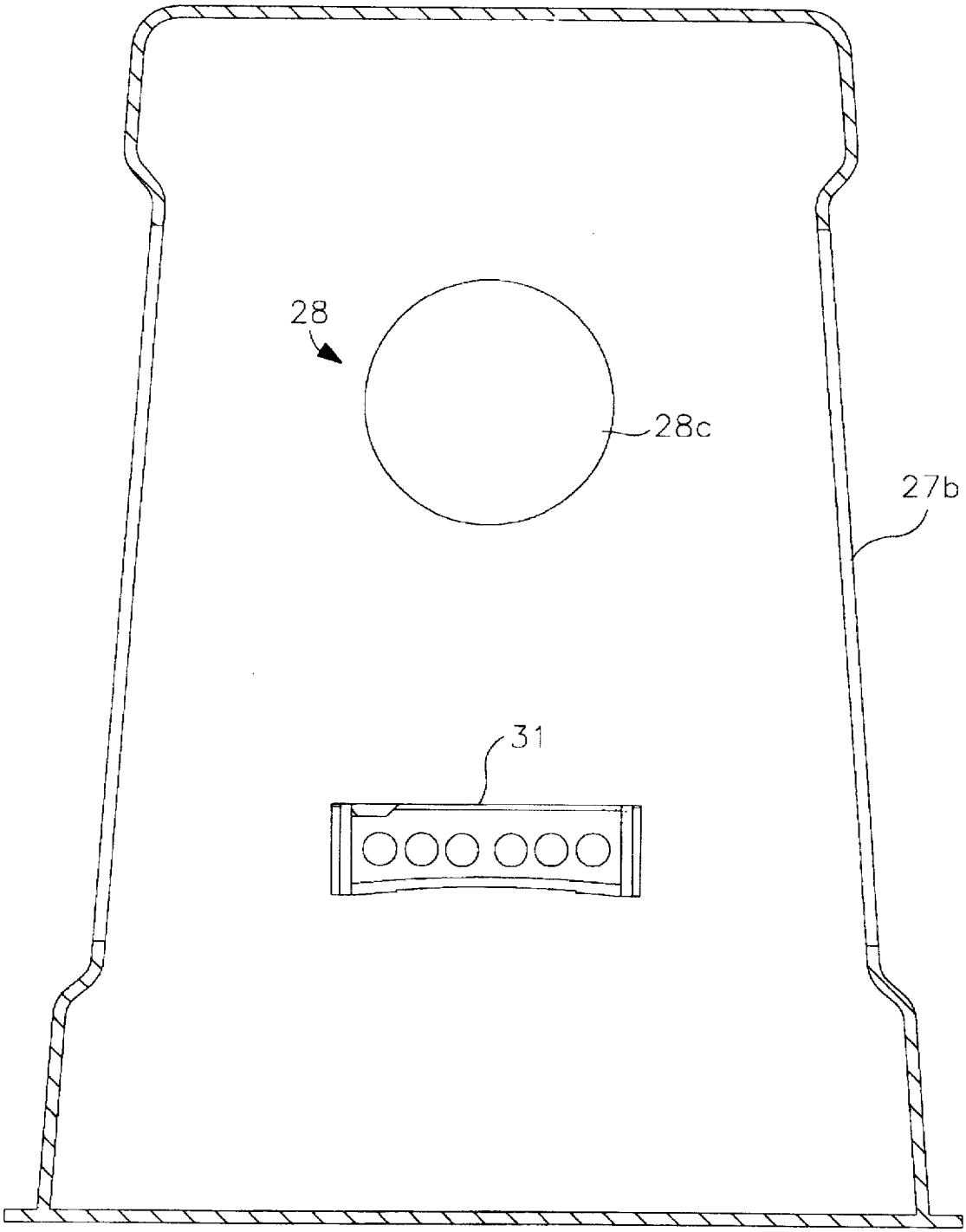
FIG. 23 is an enlarged cross-sectional view taken substantially along line 23—23 of FIG. 19.

The second carrier track 31 has one end connected to the inner end of the mid section 27b as at 31a, and the other end connected to the bottom wall of the fly section 27c as at 31b. The carrier track 31 is bent back on itself so that the rolling bight portion 31c faces in a rearward direction toward the base section 27a. FIG. 22 illustrates the connections 30a, 31a of the carrier tracks 30, 31 to the inner end of the mid section 27b, wherein a bracket 32 is provided to which the respective ends of the carrier tracks 30, 31 are secured. The bracket 32 is integral with and depends from a collar 33 mounted within the mid section 27b through which the dual rod hydraulic cylinder 28 extends.

As in the carrier track system as shown and described in connection with the embodiment of FIGS. 1 to 18, the carrier tracks are positioned interiorly of the respective boom sections 27a and 27c, and are guided therein by spaced longitudinally extending channels 34 and 35 positioned at the bottom corners of the base section 27a and fly section 27c, respectively, and extending substantially the lengths thereof. The channels 34 and 35 reinforce the side walls of the base section 27a and fly section 27c; they provide housings for fixed conduits 29a adapted to be connected to the flexible hydraulic hoses and electrical cables 29 carried by the carrier tracks 30, 31; the respective spaces between the channels provide troughs 36 for guiding the carrier tracks 30, 31 within the boom sections 27a and 27c, and as shown in FIG. 22, the top surfaces of channels 34 support the bottom rear wear pads 37 on the mid section 27b for sliding movement.

Figure 19:
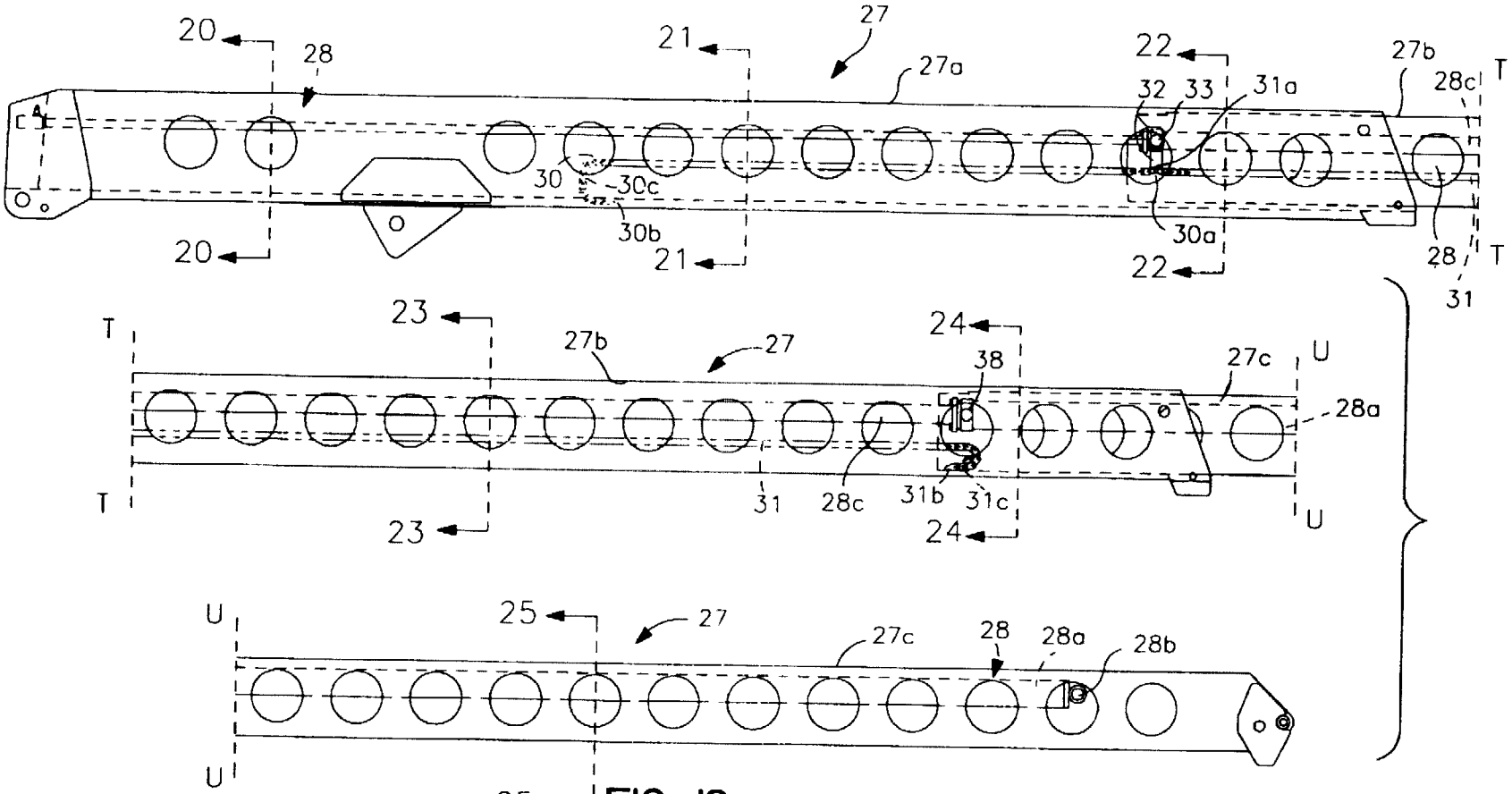
FIG. 19 is a side elevational view of a three-section telescopic boom for use in supporting an aerial work platform or the like, rather than being used as the telescopic riser assembly in the first embodiment of the invention, and showing a variation of the carrier track system in such a boom to show the versatility of the invention, the telescopic boom being shown in the extended position and the drawing Figure consisting of three portions which are joined longitudinally on the match lines T—T and U—U, respectively.
Figure 20:
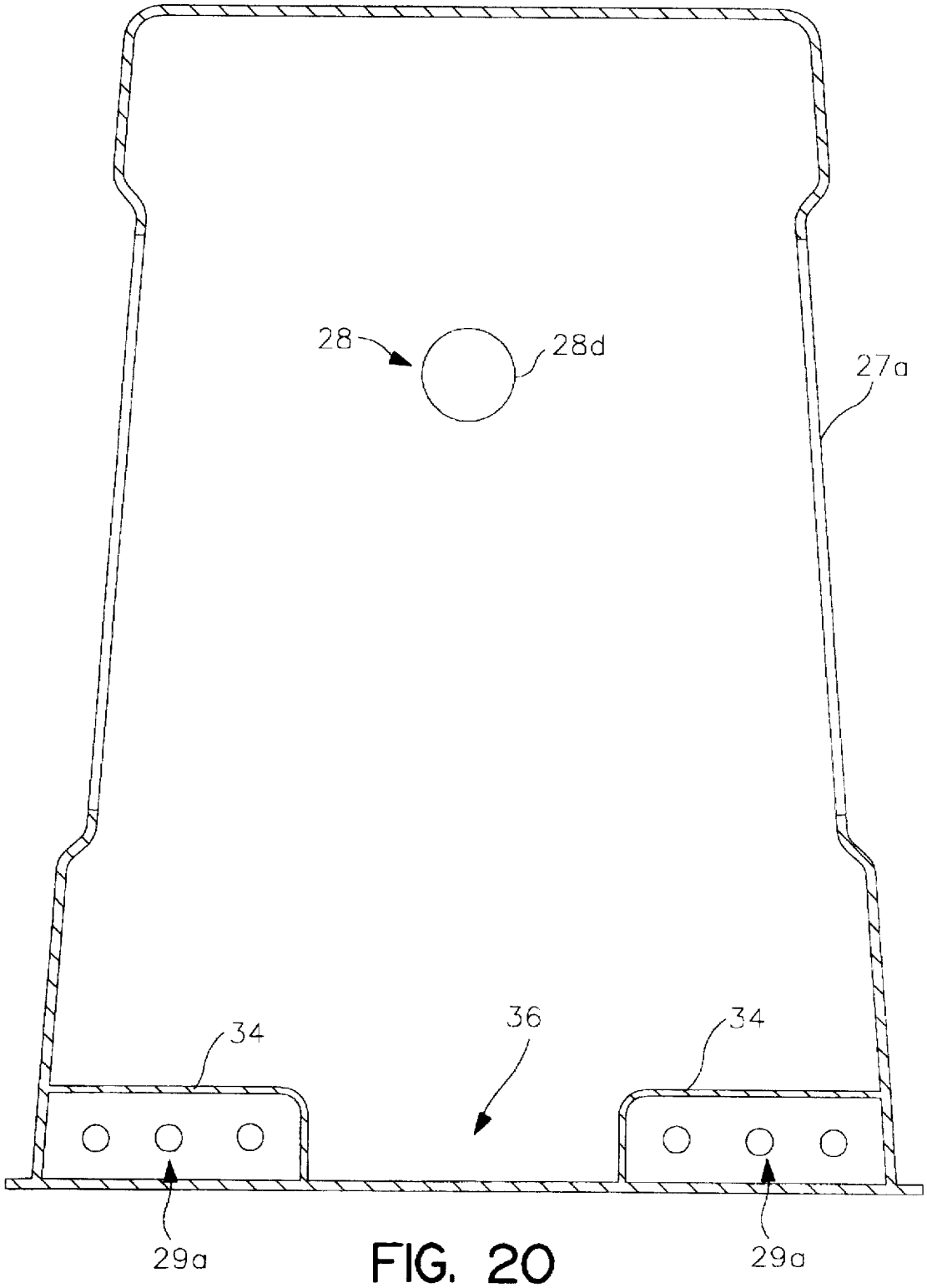
FIG. 20 is an enlarged cross-sectional view taken substantially along line 20—20 or FIG. 19.
Figure 21:
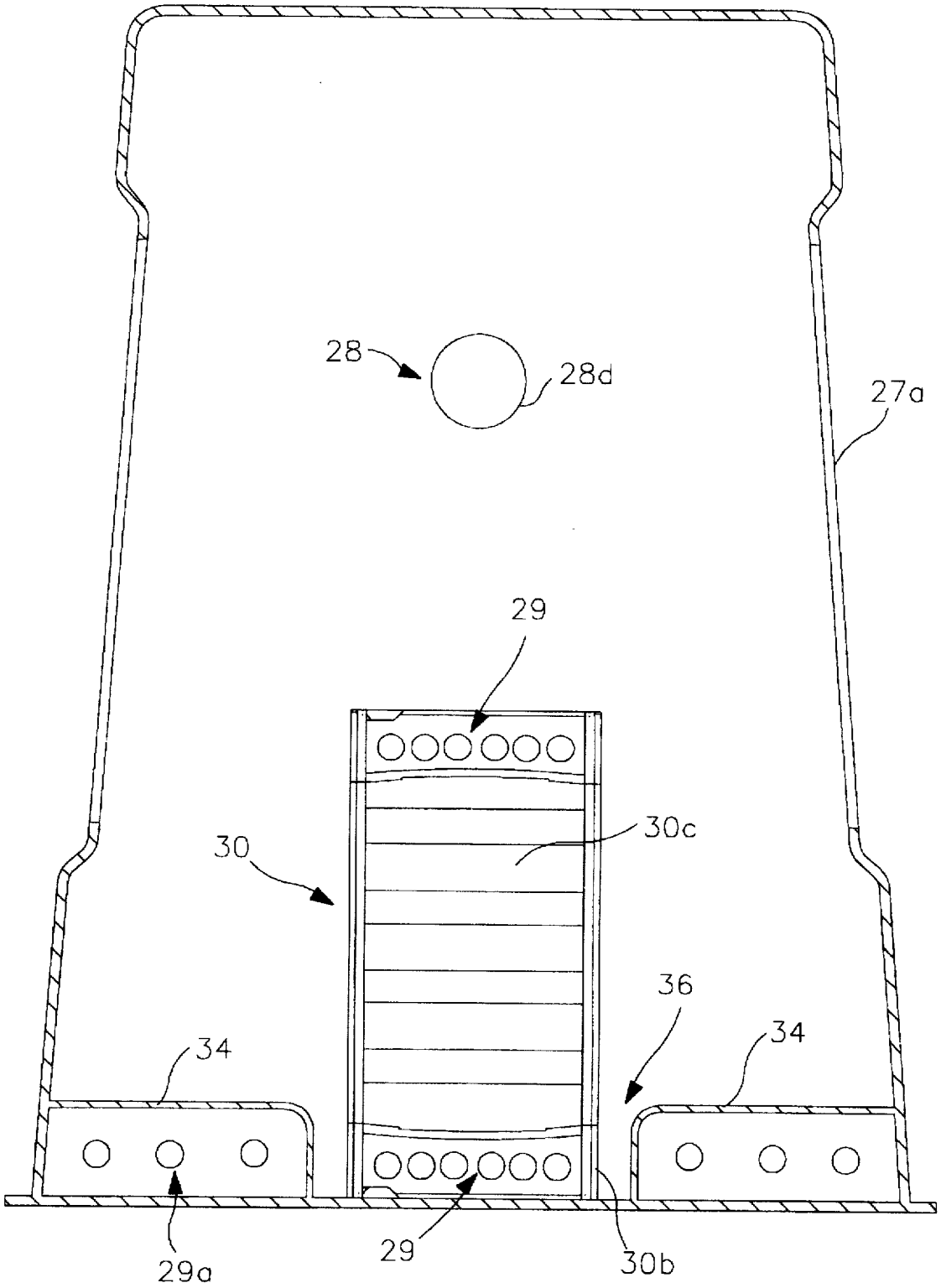
FIG. 21 is an enlarged cross-sectional view taken substantially along line 21—21 of FIG. 19.
Figure 24:
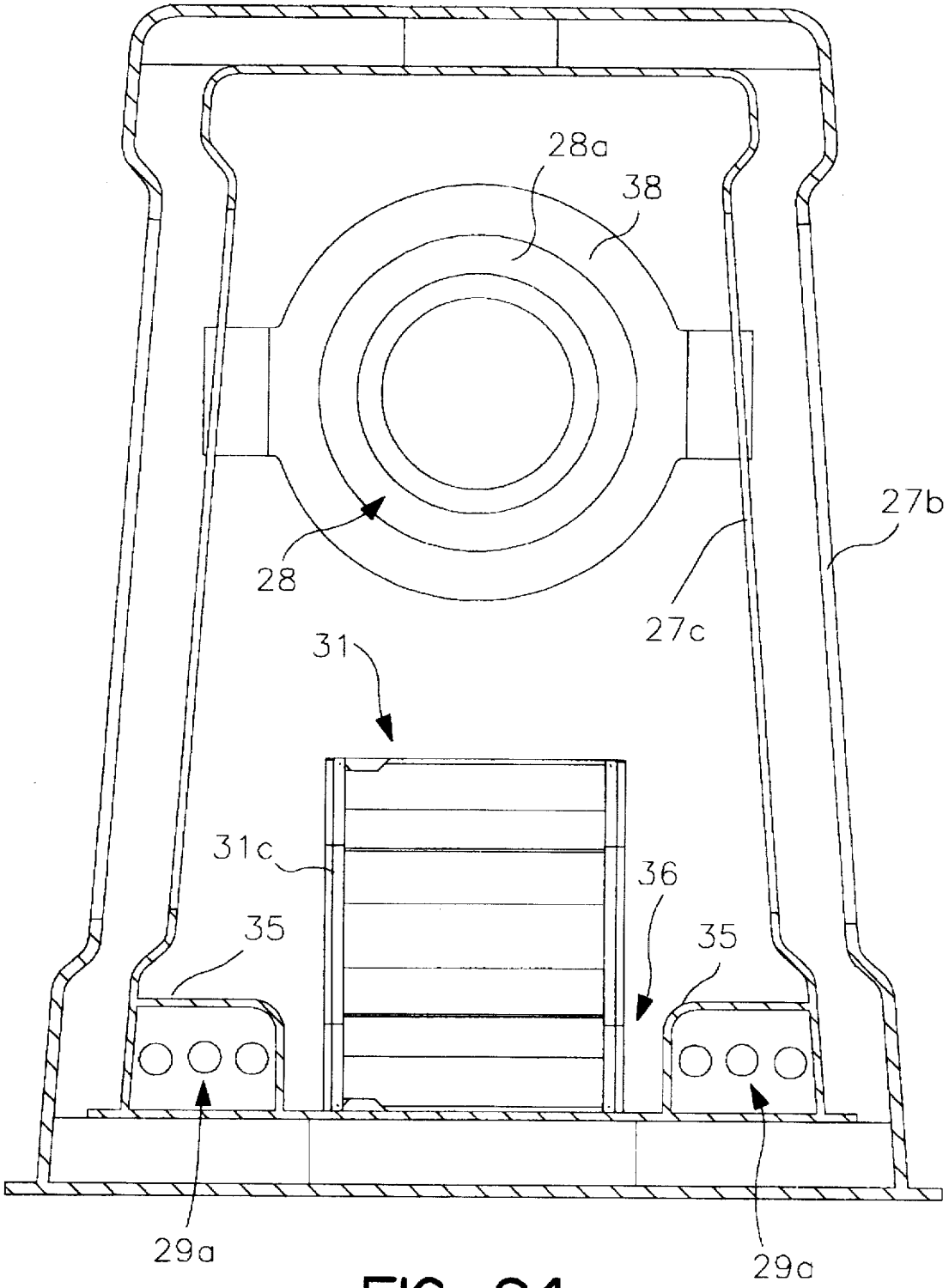
FIG. 24 is an enlarged cross-sectional view taken substantially along line 24—24 of FIG. 19.
Figure 25:
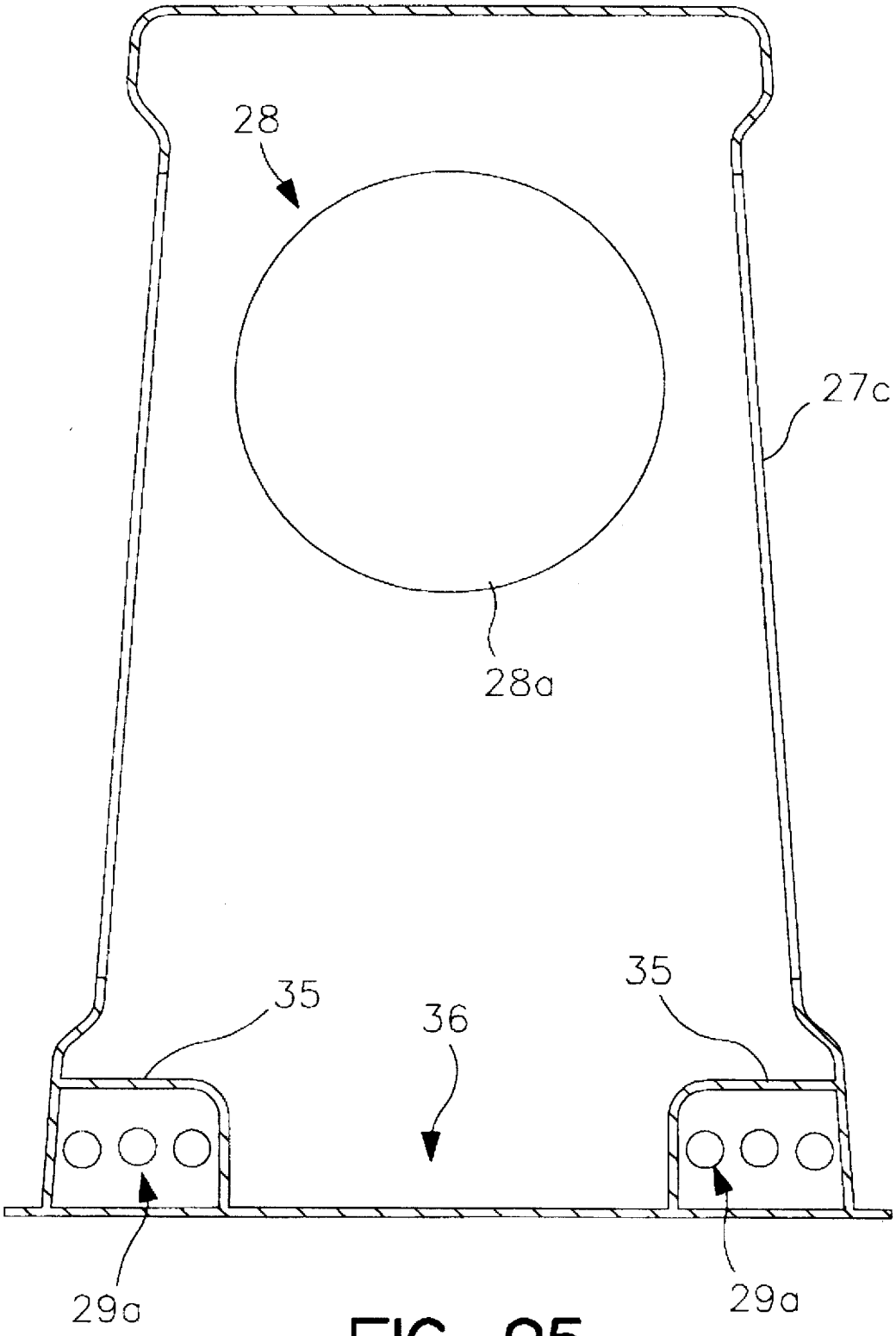
FIG. 25 is an enlarged cross-sectional view taken substantially along line 25—25 of FIG. 19.
Figure 26:
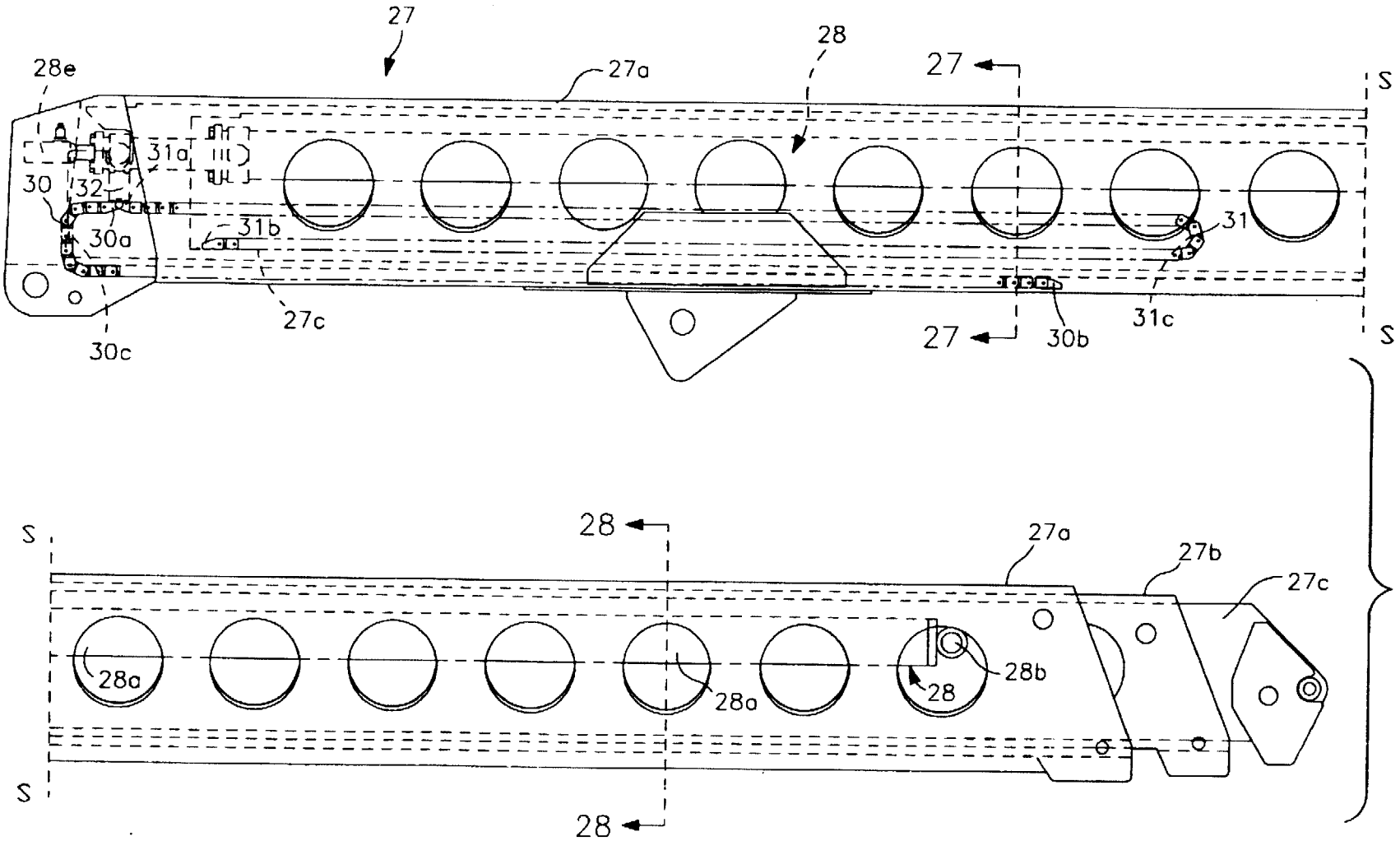
FIG. 26 is an enlarged side elevational view of the three-section telescopic boom of FIG. 19 in the retracted position, the drawing Figure consisting of two portions which are joined longitudinally on the match line S—S, and showing the carrier track system in phantom in the retracted position of the boom.
Figure 27:
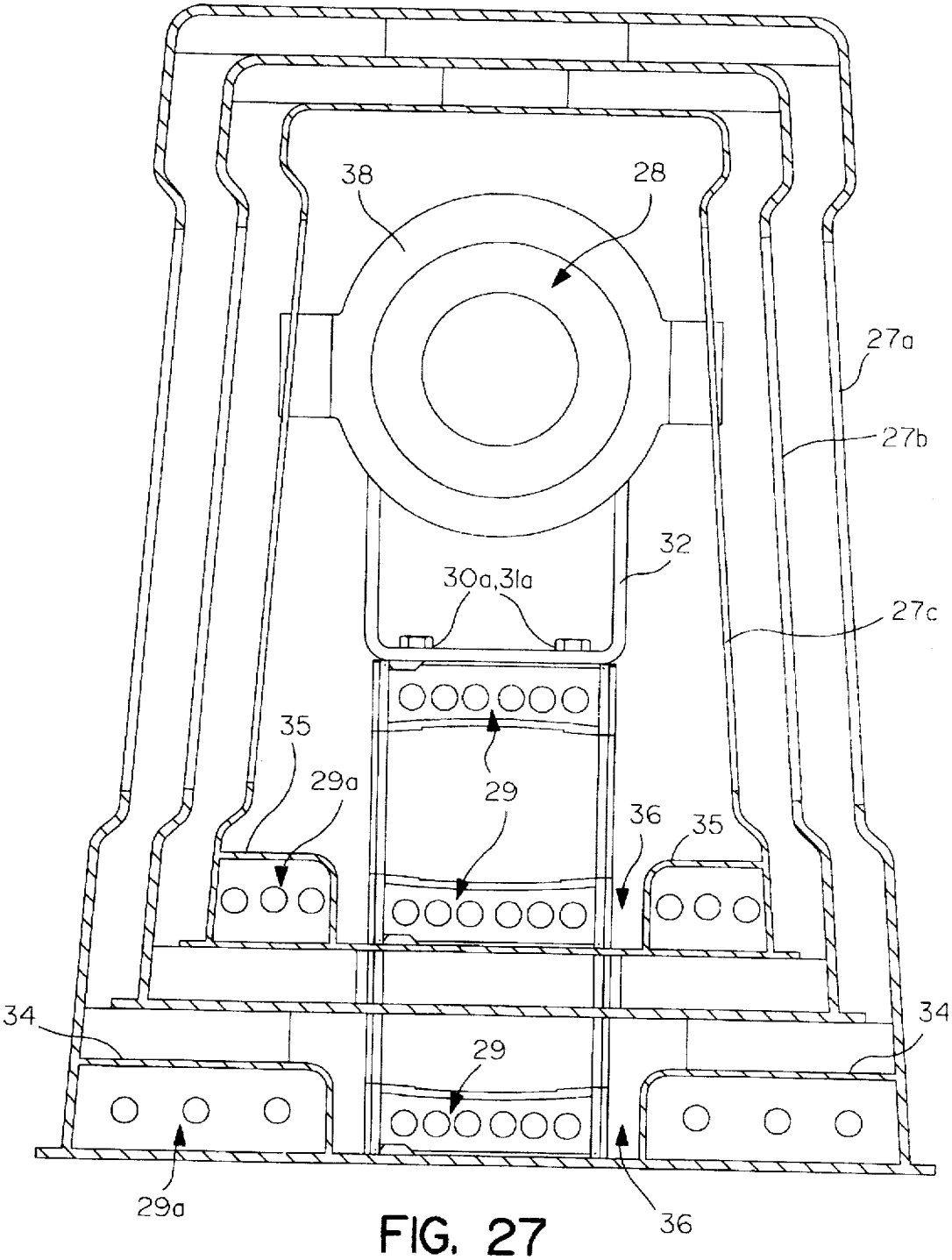
FIG. 27 is an enlarged cross-sectional view taken substantially along line 27—27 of FIG. 26.
Figure 28:
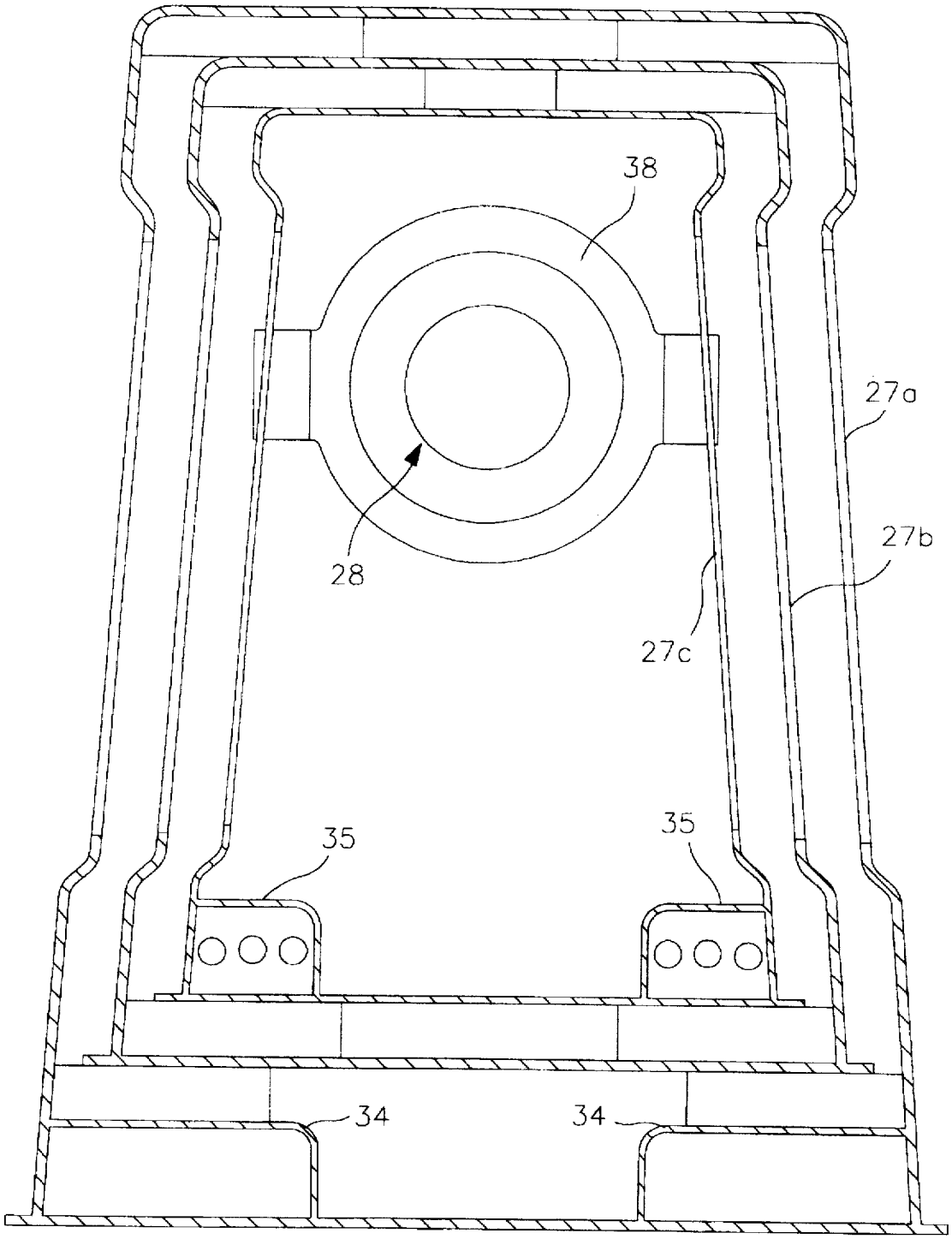
FIG. 28 is an enlarged cross-sectional view taken substantially along line 28—28 of FIG. 26.
Figure 29:
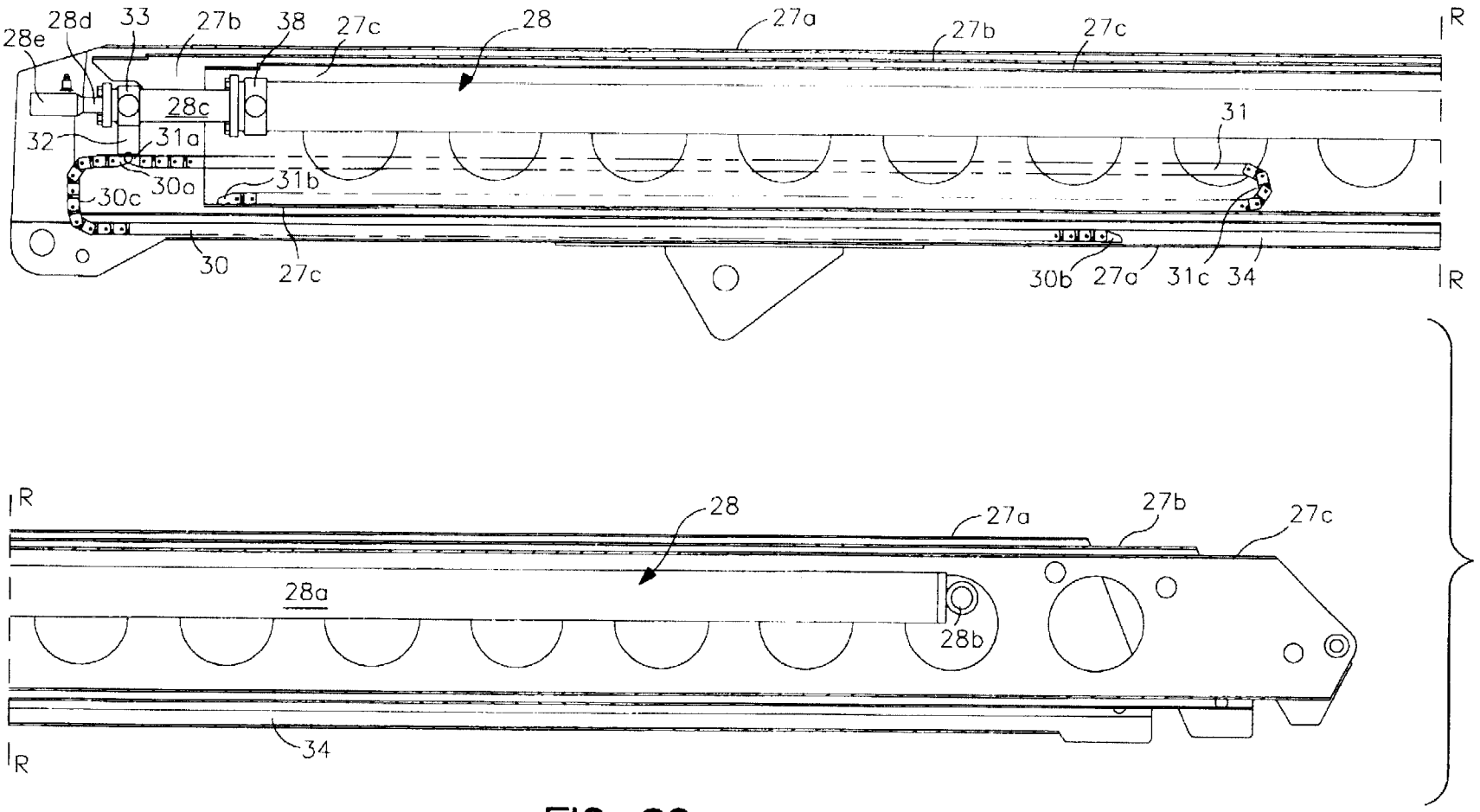
FIG. 29 is a longitudinal sectional view of the telescopic boom of FIG. 26, with the drawing Figure consisting of two portions which are joined longitudinally on the match line R—R.
Figure 30:
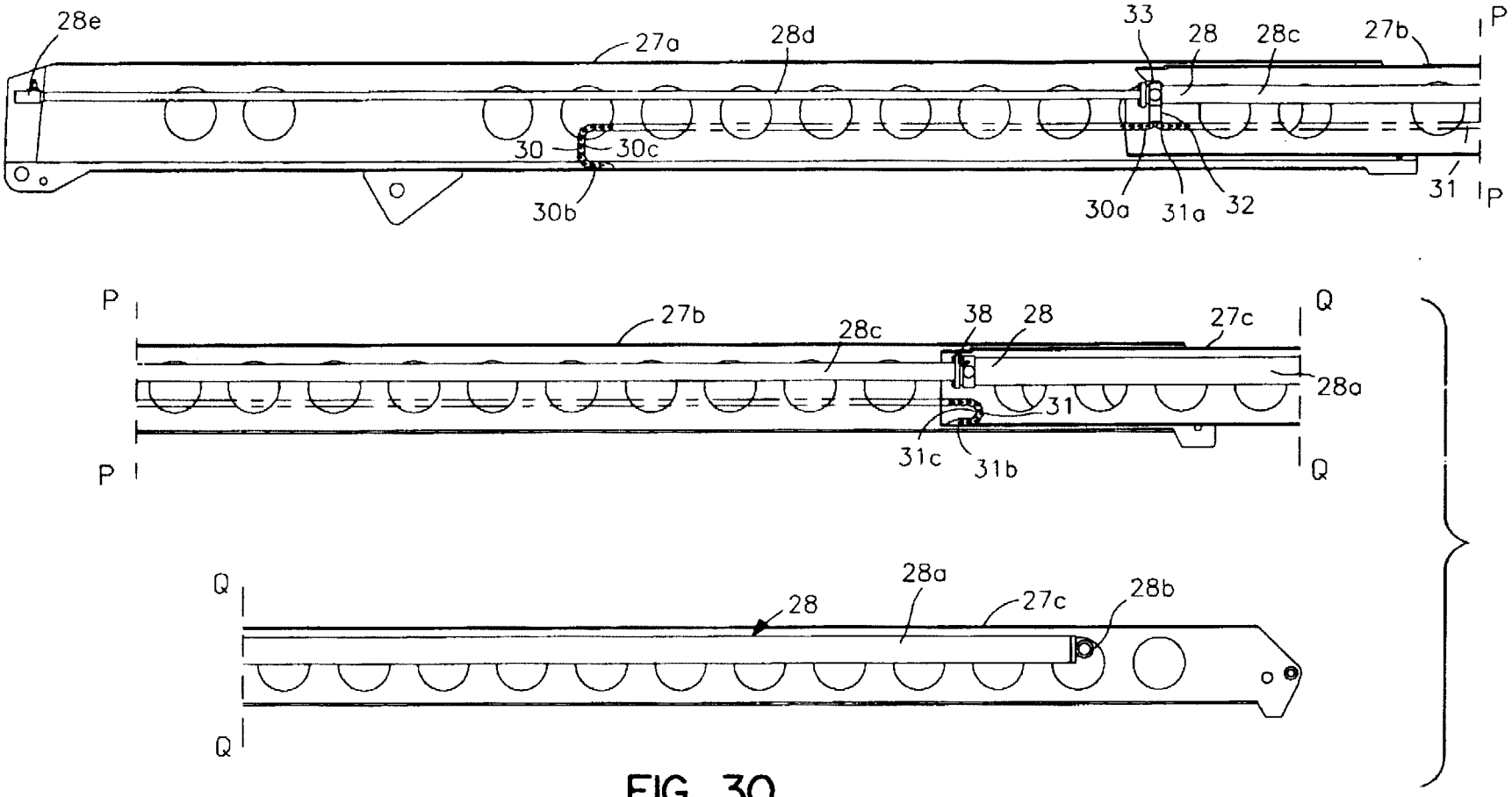
FIG. 30 is a longitudinal cross-sectional view of the telescopic boom of FIG. 19 in the extended position, and the drawing Figure consisting of three portions which are connected longitudinally on the match lines P—P and Q—Q.

The dual rod hydraulic cylinder 28 for operating the telescopic boom sections is similar to the dual rod hydraulic cylinder 9 described in connection with the embodiment illustrated in FIGS. 1 to 18, and comprises a cylinder portion 28a connected at its closed end to the fly section 27c, as at 28b, FIG. 19. The cylinder portion 28a extends through a collar 38 pivotally mounted on the inner end of the fly section 27c, as shown in FIGS. 19 and 24. A first tubular rod 28c has one end slidably mounted in the cylinder 28a and the opposite end extending through the collar 33, as shown in FIG. 22, pivotally connected to the rear end of mid section 27b. A second tubular rod 28d has one end slidably mounted within the tubular rod 28c, and the other end being closed and connected to the inner end of the base section 28a as at 28e.

From the above description it will be readily appreciated by those skilled in the art that the carrier track system of the present invention is an improvement over theretofore employed carrier track systems in that the carrier track system of the present invention accommodates flexible hydraulic hoses and electrical cables employed in multi-section telescopic boom structures, wherein the boom sections can be extended and retracted independently or in a synchronized manner relative to each other. The provision of the longitudinally extending channels in the base section and fly section not only provides a housing for fixed conduits and cables, but also reinforces a guide trough for the carrier tracks, and provides a sliding support surface for the wear pads on the mid section.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A carrier track system for a multi-section boom structure including a base section, a mid section and a fly section, wherein the boom sections are selectively operable in an independent or synchronous manner relative to each other, said carrier track system comprising:

a first carrier track, said first carrier track positioned within the mid section and base section, one end of said first carrier track being connected to the inner end of the mid section, the other end of said first carrier track being connected to the bottom wall of the base section, said first carrier track being bent back upon itself to form a bight portion facing in a direction toward the fly section;

a second carrier track, said second carrier track positioned within the mid section and fly section, one end of said second carrier track being fixed to the inner end of the mid section, the other end of said second carrier track being secured to the bottom wall of the fly section at the inner end thereof, the second carrier track being bent back on itself to form a bight portion facing in a direction toward the base section;

flexible hydraulic hoses and electrical cables being supported on said first and second carrier tracks; and a hydraulic cylinder positioned within and connected between the base, mid and fly sections for selectively extending and retracting the mid and fly sections independently or in a synchronous manner relative to each other, whereby the first and second carrier tracks accommodate the movement of the flexible hydraulic hoses and electrical cables during the telescopic movement of the mid and fly sections, to thereby prevent damage to the hoses and cables.

2. A carrier track system according to claim 1, wherein the fly section is polygonal in cross-section, a pair of spaced channels mounted in the bottom inside corners of the fly section, fixed hydraulic hoses and fixed electrical conduits being positioned in said channels, the second carrier track being positioned in the space between said channels, whereby the channels provide a guide for the second carrier track.

3. A carrier track system according to claim 2, wherein the channels are fixedly connected to the bottom and side walls of said fly section, whereby the side walls of the fly section are reinforced against buckling due to excess stress.

4. A carrier track system according to claim 1, wherein a longitudinally extending cable support tube is positioned within the mid section, said tube being fixedly connected at one end thereof to the inner end of said mid section, said one end of said second carrier track being connected to the opposite end of said tube.

5. A carrier track system according to claim 1, wherein the hydraulic cylinder comprises a dual rod cylinder having its cylinder mounted in said fly section, a first tubular rod slidably mounted in said cylinder and extending through the mid section and a second tubular rod slidably mounted in said first tubular rod, and extending into said base section, said second tubular rod being connected to the base section.

6. A carrier track system according to claim 5, wherein a collar is mounted within said mid section, said first tubular rod extending through said collar, a depending bracket secured to said collar, said one end of said first carrier track being connected to said bracket, and said one end of said second carrier track being connected to said bracket.

7. A carrier track system according to claim 1, wherein the multi-section boom structure comprises a riser assembly supporting a mobile aerial work platform.

8. A carrier track system for a multi-section boom structure including a base section, a mid section and a fly section, wherein the boom sections are selectively operable in an independent or synchronous manner relative to each other, said carrier track system comprising first and second carrier tracks, said first carrier track positioned within the mid section and base section, one end of said first carrier track being connected to the inner end of the mid section, the other end of said first carrier track being connected to the bottom wall of the base section, said first carrier track being bent back upon itself to form a bight portion facing in a direction toward the fly section, said second carrier track positioned within the mid section and fly section, one end of said second carrier track being connected to the inner end of the mid section, the other end of said second carrier track being secured to the bottom wall of the fly section at the inner end thereof, the second carrier track being bent back on itself to form a bight portion facing in a direction toward the base section, flexible hydraulic hoses and electrical cables being supported on said first and second carrier tracks, a hydraulic cylinder positioned within and connected between the base, mid and fly sections for selectively extending and retracting the boom sections independently or in a synchronous manner relative to each other, whereby the first and second carrier tracks accommodate the movement of the flexible hydraulic hoses and electrical cables during the telescopic movement of the boom sections, to thereby prevent damage to the hoses and cables; the base section being polygonal in cross-section having a continuous planar bottom wall, and a pair of spaced channels mounted in the bottom inside corners of the base section, said channels being fixedly connected to the bottom wall and side walls of said base section, fixed hydraulic hoses and fixed electrical conduits positioned in said channels, the first carrier track being positioned in the space between said channels, whereby the channels provide not only a guide for the first carrier track but also a reinforcement for the side walls to prevent buckling thereof due to excess stress.

9. A carrier track system according to claim 8, wherein wear pads are mounted on the bottom wall of the mid section at the inner end thereof, said channels having top surfaces, and said wear pads being slidably mounted on the top surfaces of said channels.

* * * * *